US010649375B2

(12) United States Patent
Nakada et al.

(10) Patent No.: US 10,649,375 B2
(45) Date of Patent: May 12, 2020

(54) IMAGE FORMING APPARATUS CONFIGURED TO SET A START OF A FEEDING OPERATION BASED ON A VALUE RELATED TO A RATE OF TEMPERATURE RISE FOR A FIXING PORTION

(71) Applicant: CANON KABUSHIKI KAISHA, Tokyo (JP)

(72) Inventors: Takeharu Nakada, Utsunomiya (JP); Tomoo Akizuki, Kawasaki (JP); Ryo Morihara, Tokyo (JP); Masahiko Suzumi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/272,477

(22) Filed: Feb. 11, 2019

(65) Prior Publication Data

US 2019/0250542 A1 Aug. 15, 2019

(30) Foreign Application Priority Data

Feb. 13, 2018 (JP) ..... 2018-022967

(51) Int. Cl.
*G03G 15/20* (2006.01)
*G03G 15/00* (2006.01)

(52) U.S. Cl.
CPC ..... *G03G 15/2039* (2013.01); *G03G 15/2028* (2013.01); *G03G 15/657* (2013.01); *G03G 15/6564* (2013.01); *G03G 2215/00599* (2013.01); *G03G 2215/00603* (2013.01); *G03G 2215/2035* (2013.01)

(58) Field of Classification Search
USPC ..... 399/69
See application file for complete search history.

(56) References Cited

U.S. PATENT DOCUMENTS

| | | | | |
|---|---|---|---|---|
| 7,283,763 | B2 | 10/2007 | Akizuki et al. | |
| 8,948,640 | B2 | 2/2015 | Takeuchi et al. | |
| 9,213,278 | B2 | 12/2015 | Namiki | |
| 9,501,003 | B2 | 11/2016 | Namiki | |
| 2015/0253703 | A1* | 9/2015 | Takane | G03G 15/2039 399/70 |

FOREIGN PATENT DOCUMENTS

| | | | |
|---|---|---|---|
| JP | H08-76636 | A | 3/1996 |
| JP | 2001-236126 | A | 8/2001 |
| JP | 2013-160980 | A | 8/2013 |
| JP | 2013-250427 | A | 12/2013 |

* cited by examiner

*Primary Examiner* — Quana Grainger
(74) *Attorney, Agent, or Firm* — Venable LLP

(57) ABSTRACT

An image forming apparatus includes an image forming portion, a fixing portion, a temperature detecting portion, a measuring portion, a storing portion, and a controller. The controller is capable of setting a case that a start of feeding of a recording material is permitted after a lapse of a predetermined time need to measure a temperature rising rate of the fixing portion and a case that the start of feeding of the recording material is permitted, depending on a value relating to the temperature rising rate stored in the storing portion, at timing before the lapse of the predetermined time.

24 Claims, 17 Drawing Sheets

| ⊿T | STATE | POWER | DEVICE | TIME UNTIL PERMISSION |
|---|---|---|---|---|
| A≦⊿T | I | 1000-1050W | COLD | 0.6sec |
| | | | HOT | 0.3sec |
| B≦⊿T<A | II | 950-1000W | COLD | 1.1sec |
| | | | HOT | 0.8sec |
| C≦⊿T<B | III | 900-950W | COLD | 1.6sec |
| | | | HOT | 1.3sec |
| D≦⊿T<C | IV | 850-900W | COLD | 2.6sec |
| | | | HOT | 2.3sec |
| E≦⊿T<D | V | 800-850W | COLD | 3.6sec |
| | | | HOT | 3.3sec |
| F≦⊿T<E | VI | 750-800W | COLD | 4.6sec |
| | | | HOT | 4.3sec |
| ⊿T<F | VII | 700-750W | COLD | 5.6sec |
| | | | HOT | 5.3sec |

FIG.7

SHEET FEEDING START TIMING DETERMINING SEQUENCE

DETERMINING SEQUENCE(COMP.EX.1)

| | PRINT INSTRUCTION | 1ST | 2ND | 3RD | 4TH | 5TH | 6TH |
|---|---|---|---|---|---|---|---|
| | SUPPLIED POWER | 925W | 925W | 975W | 975W | 1025W | 1025W |
| | TEMP.RISING RATE MEASURING TIME | 1.5sec | 1.5sec | 1.5sec | 1.5sec | 1.5sec | 1.5sec |
| | EXPOSURE PERMISSION TIMING | 0.5sec | 0.5sec | 0.5sec | 0.5sec | 0.5sec | 0.5sec |
| COMP. EX.1 | POWER STATE (N-TH) | III | III | II | II | I | I |
| | FIXING PERMISSION TIMING(N-TH) | 1.6sec | 1.6sec | 1.1sec | 1.1sec | 0.6sec | 0.6sec |
| | FEEDING START TIMING(N-TH) | 1.6sec | 1.6sec | 1.5sec | 1.5sec | 1.5sec | 1.5sec |
| | FPOT(N-TH) | 5.0sec | 5.0sec | 4.9sec | 4.9sec | 4.9sec | 4.9sec |
| FIRST EMB. | POWER STATE ((N-1)-TH) | - | III | III | II | II | I |
| | FIXING PERMISSION TIMING((N-1)-TH) | - | 1.6sec | 1.6sec | 1.1sec | 1.1sec | 0.6sec |
| | POWER STATE (N-TH) | III | III | II | II | I | I |
| | FIXING PERMISSION TIMING(N-TH) | 1.6sec | 1.6sec | 1.1sec | 1.1sec | 0.6sec | 0.6sec |
| | FEEDING START TIMING(N-TH) | 1.6sec | 1.6sec | 1.5sec | 1.1sec | 1.1sec | 0.6sec |
| | FPOT(N-TH) | 5.0sec | 5.0sec | 4.9sec | 4.5sec | 4.5sec | 4.0sec |

FIG.11

IMAGE FORMING APPARATUS CONFIGURED TO SET A START OF A FEEDING OPERATION BASED ON A VALUE RELATED TO A RATE OF TEMPERATURE RISE FOR A FIXING PORTION

FIELD OF THE INVENTION AND RELATED ART

The present invention relates to an image forming apparatus such as a copying machine using electrophotography or an electrophotographic printer.

In general, a start timing for sheet feeding is set (sheet feeding start timing, when a print instruction in an image forming apparatus is received, at the later one of exposure permission timing and fixing permission timing. Here, the exposure permission timing refers to the number of rotations of a scanner motor (polygon mirror driving motor) for scanning a photosensitive drum surface with laser light being greater than or equal to a predetermined number of rotations. The fixing permission timing is the time for a temperature of a fixing device to be greater than or equal to a predetermined temperature. The fixing device applies heat and pressure to toner in order to fix the toner on a recording material.

In such an image forming apparatus, energy supplied to a heater is maximized in order to make the temperature of the fixing device a fixable temperature as early as possible.

In recent years, requirements of the image forming apparatus have including shortening a time from receipt of a print instruction until a first recording material is outputted (first printout time (FPOT)). Accordingly, it is desired that FPOT is shortened while ensuring a good fixing property.

In order to shorten the FPOT, Japanese Laid-Open Patent Application (JP-A) 2013-160980 discloses that sheet feeding start timing is determined depending on a rate of temperature rise (temperature rise speed) of the member constituting the fixing device in a predetermined time after the print instruction is received.

However, in JP-A 2013-160980, a predetermined time (necessary measuring time) in which the temperature rising rate of the member of the fixing device is measured is needed to estimate the sheet feeding start timing with accuracy. For that reason, it is difficult to make the sheet feeding start timing earlier than the end of the necessary measuring time, and therefore, a time obtained by subtracting a recording material feeding temperature from the FPOT cannot be made shorter than the necessary measuring time.

SUMMARY OF THE INVENTION

A principal object of the present invention is to provide an image forming apparatus capable of further shortening an FPOT from the viewpoint of usability.

According to an aspect of the present invention, there is provided an image forming apparatus comprising: an image forming portion configured to form a toner image on a recording material; a fixing portion configured to fix the toner image on the recording material by heating the toner image formed on the recording material; a temperature detecting portion configured to detect a temperature of the fixing portion; a measuring portion configured to measure, with the temperature detecting portion, a temperature rising rate of the fixing portion when the temperature of the fixing portion rises, upon receipt of a print instruction, to a predetermined temperature at which the toner image is fixable; a storing portion configured to store a value relating to the temperature rising rate measured by the measuring portion; and a controller configured to control feeding start timing of the recording material, wherein the controller is capable of setting a case that a start of feeding of the recording material is permitted after a lapse of a predetermined time need to measure the temperature rising rate and a case that the start of feeding of the recording material is permitted, depending on the value stored in the storing portion, at timing before the lapse of the predetermined time.

According to another aspect of the present invention, there is provided an image forming apparatus comprising: an image forming portion configured to form a toner image on a recording material; a fixing portion including a heater and configured to fix the toner image on the recording material by heating the toner image formed on the recording material; a temperature detecting portion configured to detect a temperature of the fixing portion; a measuring portion configured to measure, with the temperature detecting portion, a temperature rising rate of the fixing portion when the temperature of the fixing portion rises, upon receipt of a print instruction, to a predetermined temperature at which the toner image is fixable; a storing portion configured to store a value relating to the temperature rising rate measured by the measuring portion; and a controller configured to control feeding start timing of the recording material, wherein the controller is capable of setting a case that a start of feeding of the recording material is permitted after a lapse of a predetermined time from a start of supply of electric power to the heater in response to a print instruction and a case that the start of feeding of the recording material is permitted, depending on the value stored in the storing portion, at timing before the lapse of the predetermined time.

Further features of the present invention will become apparent from the following description of exemplary embodiments with reference to the attached drawings.

BRIEF DESCRIPTION OF THE DRAWINGS

FIG. 7 is a correspondence table among a temperature rising rate ΔT, a power state, an estimated supplied power, a fixing device state and a time from receipt of a print instruction to arrival at fixing permission timing in a condition in which the image forming apparatus of First Embodiment is placed in a normal temperature (23° C.) environment and a plain paper mode.

FIG. 11 is a table in which experiment results of the image forming apparatuses of Comparison Example 1 ("COMP. EX. 1") and First Embodiment ("EMB. 1") are summarized.

DESCRIPTION OF EMBODIMENTS

Embodiments of the present invention will be specifically described with reference to the drawings. Dimensions, materials, shapes and relative arrangements of constituent elements described in the following embodiments should appropriately be changed depending on structures and various conditions of apparatuses to which the present invention is applied. The scope of the present invention is not intended to be limited to the following embodiments.

First Embodiment (Image Forming Apparatus)

Figure 1:
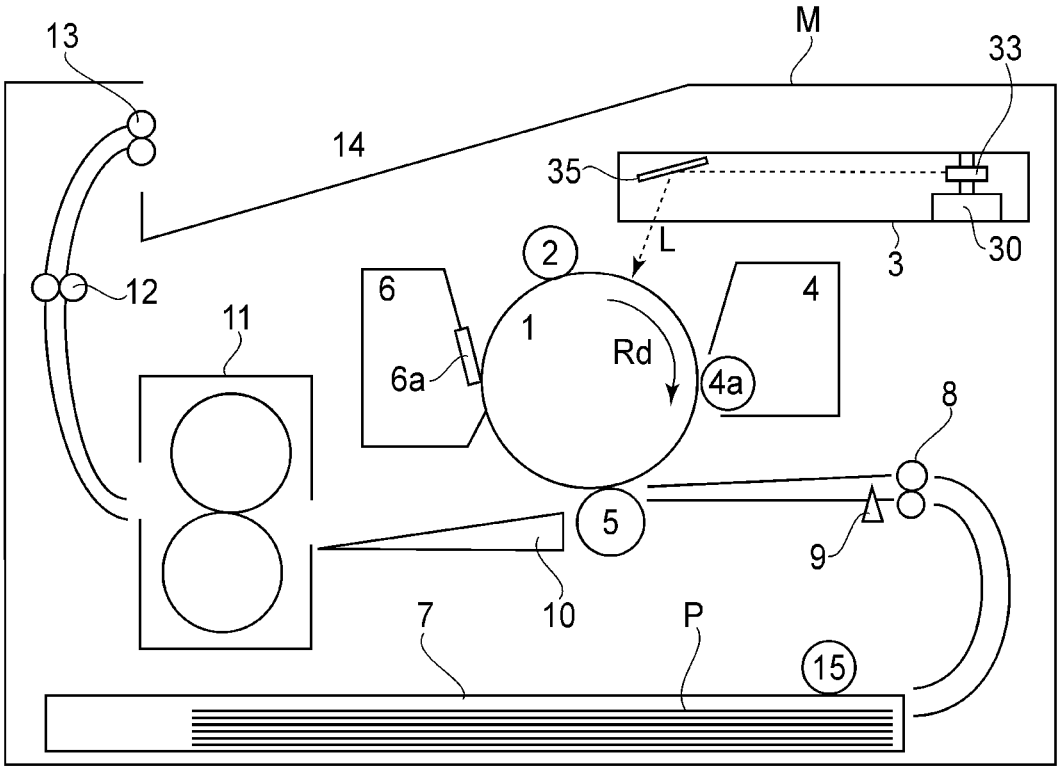
FIG. 1 is a sectional view of an image forming apparatus according to an embodiment of the present invention.

FIG. 1 is a schematic sectional view of an image forming apparatus according to an embodiment of the present invention.

In FIG. 1, a drum-shaped electrophotographic photosensitive member (hereinafter referred to as a photosensitive drum) 1, which is an image bearing member, is rotatably supported by an apparatus main assembly M and is to be rotationally driven at a predetermined process speed in an arrow Rd direction by a driving portion (unshown). At a periphery of the photosensitive drum 1 a charging device 2, a scanning portion (exposure device) 3, a developing device 4, a transfer device (transfer portion) 5 and a cleaning device 6 are successively provided in a rotation direction of the photo drum 1. The scanning portion 3 includes a scanner motor 30, a polygon mirror 33, and a reflecting mirror 35. The developing device 4 includes a developing roller 4*a*. The cleaning device 6 includes a cleaning blade 6*a*.

These members constitute an image forming portion for forming a toner image on a sheet-like recording material P such as paper. Further, the photosensitive drum 1, the charging device 2, the developing device 4, and the cleaning device 6 may also be assembled into a single unit as a cartridge mountable to and dismountable from the apparatus main assembly M.

A sheet feeding cassette 7 is provided at a lower portion of the apparatus main assembly M, and the recording material P is accommodated therein. The recording material P is fed along a feeding path in the order of a sheet (paper) feeding portion 15, a feeding roller pair 8, a top sensor 9, the transfer device 5, a metal plate-like feeding guide 10, a fixing device (fixing portion) 11, a feeding roller pair 12, a sheet discharging roller pair 13, and a sheet discharge tray 14.

Figure 4:
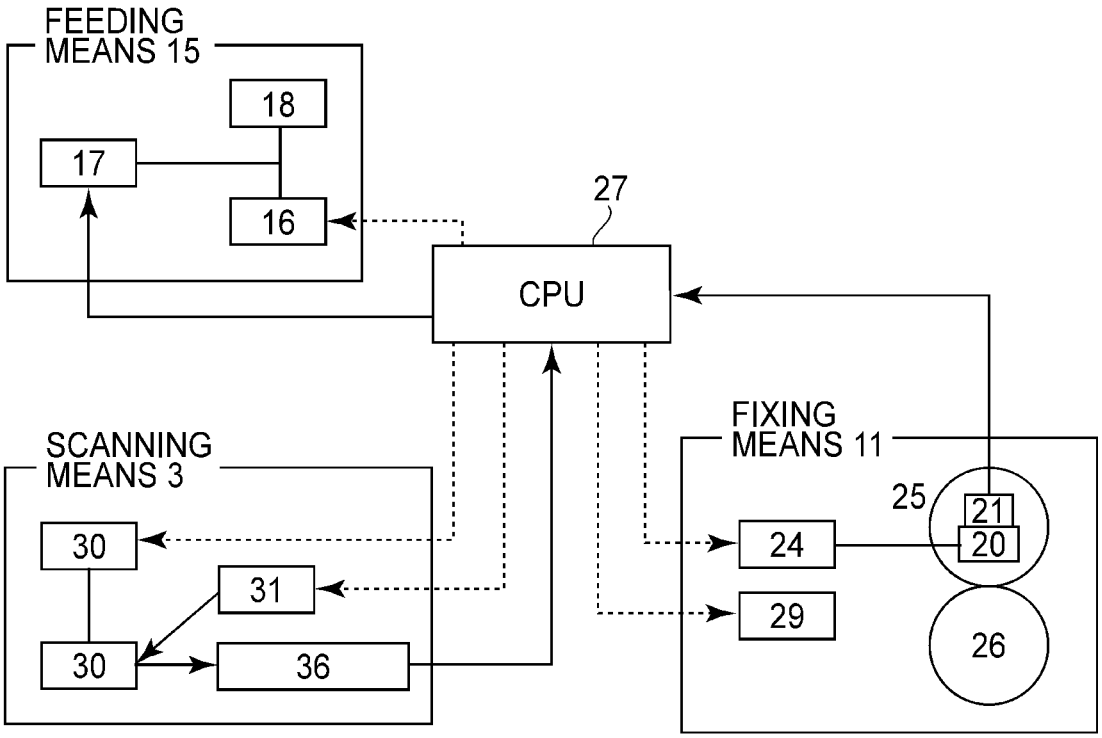
FIG. 4 is a block diagram showing a relationship among a sheet feeding portion 15, the scanning portion 3 and a fixing device (fixing portion) 11 with a CPU (temperature controlling portion) of the image forming apparatus as a central portion in this embodiment.

The sheet feeding portion 15 includes, as shown in FIG. 4, a sheet feeding roller 18 driven by a main motor 16 of the apparatus main assembly and a solenoid 17 for switching power transmission between the main motor 16 and the feeding roller 18. The main motor 16 also drives the photosensitive drum 1, the developing roller 4*a*, the feeding roller pair 8, and the like.

Figure 2:
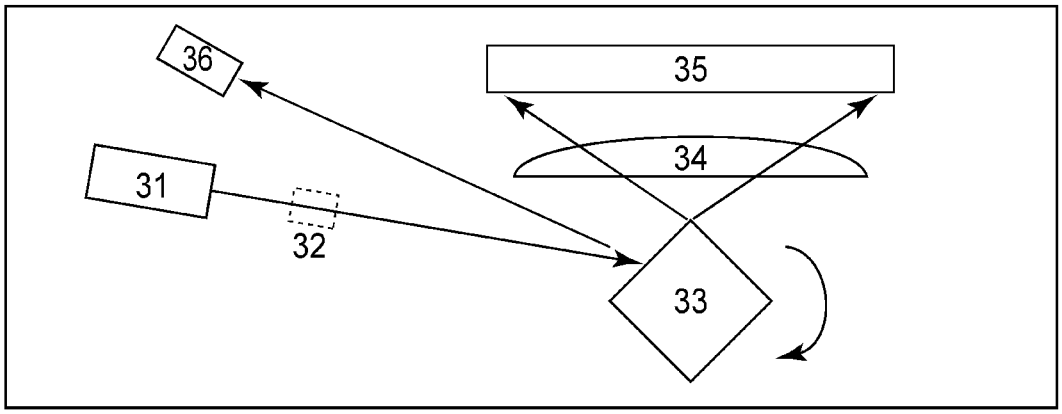
FIG. 2 is a schematic view of an exposure device (scanning portion) 3 in an image forming portion.

FIG. 2 is a schematic view of the scanning portion (exposure device) 3. An optical box of the scanning portion 3 includes a light source 31 for emitting laser light L modulated depending on image information, a collimator lens 32 for changing the laser light L emitted from the light source 31 into parallel (collimated) light, and the polygon mirror 33 for deflecting the laser light L. The optical box further includes the scanner motor 30 (the polygon mirror driving motor shown in FIG. 1) to which the polygon mirror 33 is attached, an fθ lens 34, the reflecting mirror 35, and the like.

The photosensitive drum 1 is irradiated with the laser light (FIG. 1) depending on the first information, through the reflecting mirror 35. Further, as shown in FIG. 2, a part of a scanning beam is detected by a photo-detector 36. The light emission start timing of the laser light L is controlled based on an output of the photo detector 36, so that a deviation of an image writing position with respect to a main scanning direction is suppressed. Here, the main scanning direction is a direction perpendicular to a rotational axis direction of the polygon mirror 33 and an optical axis direction of an optical lens system including the collimator lens 32 and the fθ lens 34.

The photo-detector 36 outputs a pulse signal proportional to the number of rotations (turns) of the scanner motor 30, so that a rotation state of the scanner motor 30 can be grasped from this pulse signal. The scanner motor 30 includes a bearing, which is a dynamic pressure fluid bearing. Oil is used in the bearing (oil bearing), and the viscosity of the oil used for oil bearing has temperature dependence. The oil fills a gap between a motor shaft and a bearing blanket, so that the motor shaft and the bearing blanket are not in contact with each other during rotation.

An image forming operation now will be described. First, when the image forming operation is started (when a print instruction is received), the photosensitive drum 1 rotationally driven in an arrow Rd direction by a driving portion. As the photo-drum 1 is rotated, the photo-drum 1 is uniformly electrically charged to a predetermined polarity and a predetermined potential. The photosensitive drum 1 after a surface thereof is charged is scanned with the laser light L by the scanning portion (exposure device) 3 based on image information with the result that electric charges of an exposed portion are removed, so that an electrostatic latent image is formed.

Then, this electrostatic latent image is developed by the developing device, so that a toner image is formed on the photosensitive drum 1. The developing device 4 includes the developing roller 4*a*, and a developing bias is applied to the developing roller 4*a*, so that toner is deposited on the electrostatic latent image on the photosensitive drum 1. As a result, the toner image is formed on the photosensitive drum 1.

In parallel with this toner image forming operation, the recording material P, accommodated in the sheet feeding cassette 7, is fed and controlled. The recording material P is fed and conveyed by the feeding portion 15 and the feeding roller pair 8. The recording material P passes through the top sensor 9, and thereafter, is fed to a transfer nip between the photosensitive drum 1 and the transfer roller 5. A leading end of the recording material P is detected by the top sensor 9, so that the leading end of the recording material P is synchronized with the toner image on the photosensitive drum 1. As a result, when the recording material P is fed to the transfer nip, the toner image is transferred from the photosensitive drum 1 onto a predetermined position of the recording material P by a transfer bias applied to the transfer roller 3.

Then, the recording material P on which an unfixed toner image is carried is fed along the feeding guide 10 to a fixing nip in the fixing portion 11, so that the toner image is heat-fixed on the recording material P. Thereafter, the recording material P is fed by the feeding roller pair 12 and is discharged by the discharging roller pair 13 onto the discharge tray 14 provided at an upper surface of the apparatus main assembly M. The photosensitive drum 1 is cleaned by a cleaning blade 6*a* of the cleaning device 6 after the toner image transfer and is prepared for a subsequent image formation. By repeating the above-described operation, image formation can be successively carried out.

Figure 3:
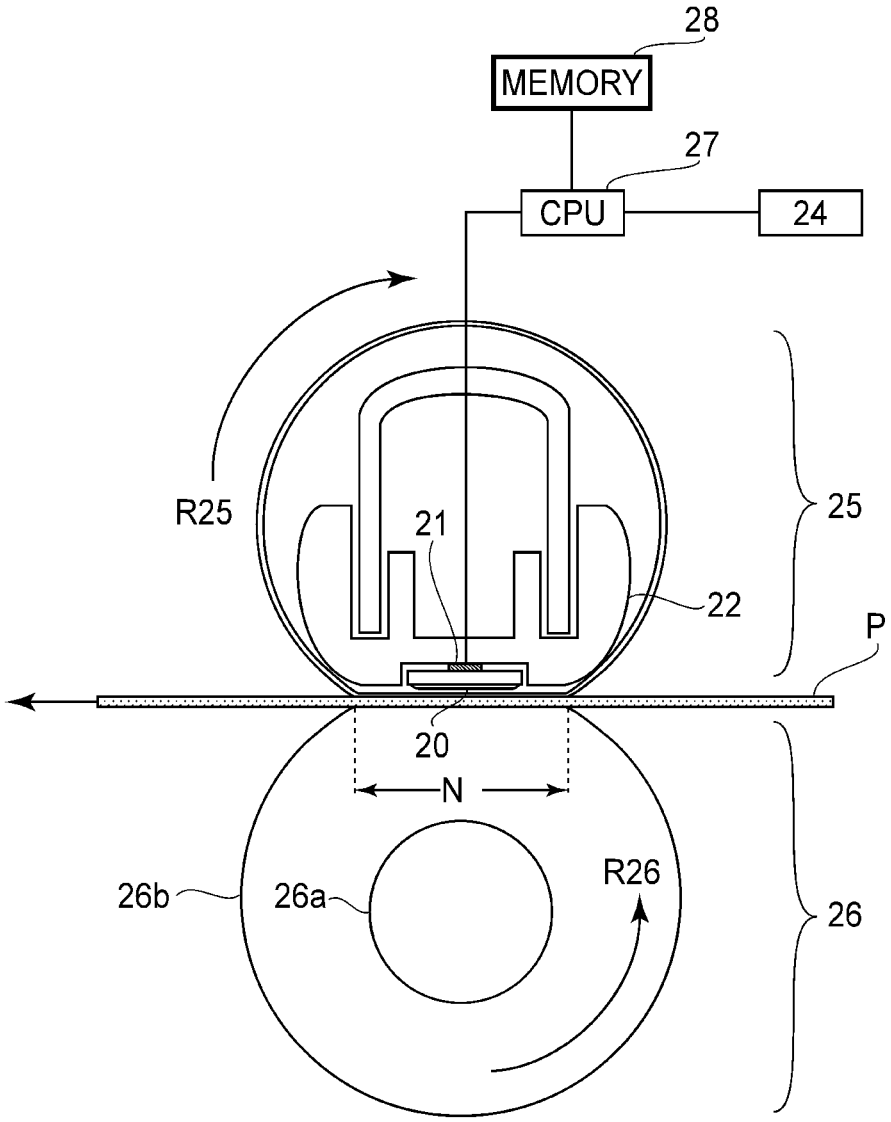
FIG. 3 is a sectional view of a fixing device 11.

FIG. 3 is a schematic sectional view of the fixing device (fixing portion) 11. The fixing device 11 includes a heater (ceramic heater) 20 as a heating member for heating the toner image, a fixing film 25 accommodating the heater 20, and a pressing roller 26 as a member for forming the fixing nip between itself and the fixing film 25 in cooperation with the heater 20. The pressing roller 26 is driven by a fixing (device) motor 29 (FIG. 4) and is prepared by forming an elastic layer 26*b* of a silicone rubber or the like on an outer peripheral surface of a core metal 26*a* (FIG. 3).

The heater 20 is held by a heater holding member (heater holder) 22 provided in the apparatus main assembly M. The heater holder 22 is made of a heat-resistant resin material and has a semi-circular shape in cross-section. This heater holder 22 also has a function of guiding rotation of the fixing film 25.

The fixing film 25 is formed of a heat-resistant resin material, such as polyimide, in a cylindrical shape and rotates around the heater 20 and the heater holder 22, described above. The fixing film 25 is pressed against the heater 20 by the pressing roller 26, so that an inner peripheral surface of the fixing film 25 contacts a lower surface of the heater 20.

The fixing film 25 is rotated in an arrow R25 direction by rotation of the pressing roller 26 in an arrow R26 direction. Incidentally, at both end surfaces of the fixing film 25 with respect to a longitudinal direction (a direction perpendicular to the drawing sheet of FIG. 3), flange portions (unshown) provided on the heater holder 22 oppose each other, and by these flange portions, movement of the fixing film 25 in the longitudinal direction is prevented.

On a back surface of the heater 20, a temperature detecting element (thermistor) 21, is provided. The thermistor 21 is a temperature detecting portion for detecting a temperature of the heater 20. That is, the thermistor 21 contacts the back surface of the heater 20, and a CPU 27 (FIG. 3) controls a triac 24 on the basis of the temperature detected by the thermistor 21 and thus controls energization to the heater 20 so that a detection temperature of the thermistor 21 is maintained at a setting temperature. When the toner image is fixed on the recording material P, the CPU 27 sets the setting temperature at a target temperature (fixing temperature) suitable for fixing the toner image.

As described above, the fixing portion 11 heats the toner image on the recording material P by the heater 20 while nipping and feeding the recording material P through the nip N by rotation of the pressing roller 26 in the arrow R26 direction (FIG. 3). At this time, by controlling the rotation of the pressing roller 26, a feeding speed of the recording material P can be appropriately controlled.

The fixing portion 11 in this embodiment starts the energization to the heater 20 after receiving a print instruction. That is, the energization to the heater 20 is not carried out in a stand-by state in which the CPU 27 awaits the print instruction, and therefore in the stand-by state, electric power consumption is very small.

FIG. 4 is a block diagram showing a relationship among the sheet feeding portion 15, the scanning portion 3, and the fixing portion 11 with the CPU as a central unit in the image forming apparatus of this embodiment. In FIG. 4, thick solid arrows represent information transmission systems transmitting information toward the CPU 27 for temperature information of the fixing portion 11 and rotation number information of the scanner motor toward the thick solid arrows also represent an instruction transmission system from the CPU 27 to the solenoid 17 of the sheet feeding portion 15. Thin solid lines in FIG. 4 represent drive transmission in the scanning portion 3, the fixing portion 11 and the sheet feeding portion 15. The broken arrows in FIG. 4 represent instruction transmission systems between the CPU 27 and each of the respective portions 3, 11 and 15.

(Sheet Feeding and Conveying Sequence)

Figure 5:
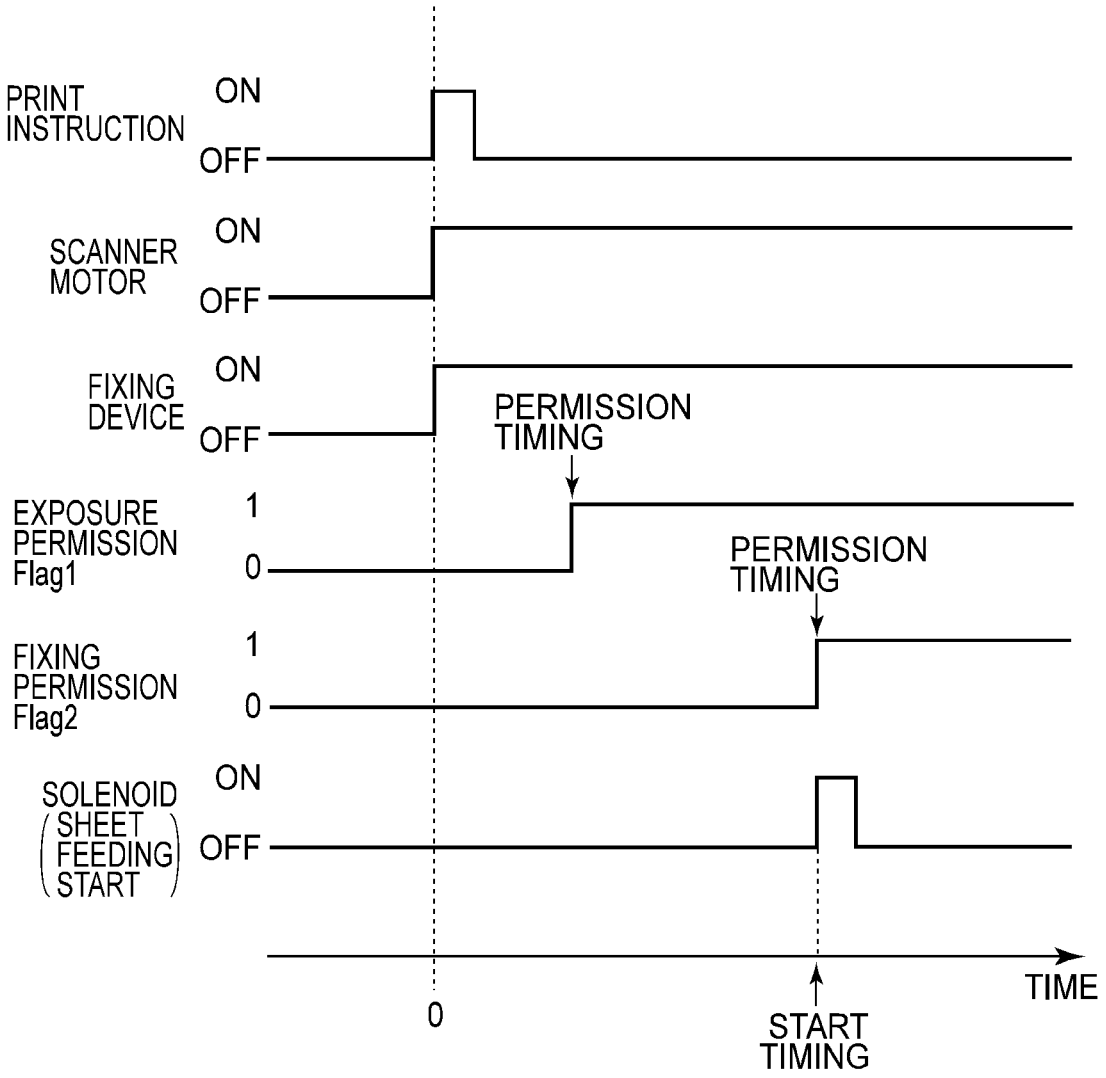
FIG. 5 is a time chart for determining sheet feeding start timing of the image forming apparatus in First Embodiment.

The image forming apparatus of this embodiment operates as shown in the time chart of FIG. 5 and determines a feeding start timing of the recording material P. That is, drive of the scanner motor is started when a print instruction is received, and at the same time, temperature control (supply of electric power to the heater 20) is started so that the temperature of the fixing portion 11 rises to a fixable temperature. Thereafter, timing when the scanning portion (exposure device) 3 is in a sheet feeding permission state (i.e., exposure permission timing, timing when Flag 1 is 1) and timing when the fixing device (fixing portion) 11 is in a sheet feeding permission state (i.e., fixing permission timing, timing when Flag 2 is 1) are monitored.

Then, the CPU 27, as a controller for controlling sheet feeding start timing of the recording material P after receiving the print instruction, determines when both Flag 1 and Flag 2 are 1 as the sheet feeding start timing, and causes the solenoid 17 to start the main motor 16 driving the feeding roller 18. As shown in the time chart of FIG. 5, in the image forming apparatus of this embodiment, a time required for preparing the fixing portion 11 is always longer than a time required for preparing the scanning portion 3, so that the sheet feeding start timing is equal to the fixing permission timing.

Here, a time obtained by adding a recording material feeding (conveying) time to a time from receipt of the print instruction to arrival at the sheet feeding start timing is the FPOT. The recording material feeding time is uniquely determined (for example, 3.4 sec) depending on a length of the recording material with respect to the feeding direction, a length of a sheet feeding path of the image forming apparatus or a process speed. For that reason, in order to further shorten the FPOT, there is a need to shorten the time from receipt of the print instruction to arrival at the sheet feeding start timing (Exposure Permission Timing)

In the following, the exposure permission timing of the scanning portion (exposure device) 3 (sheet feeding start permission timing at the exposure portion 3) in this embodiment will be described. The exposure permission timing in this embodiment is timing when, after a start of energization to the scanner motor 30, the number of rotations is 98.3% or more of a target number of rotations (100%) when scanning depending on image information is carried out.

In the case where a periphery of the device is in a low-temperature environment, viscosity of oil becomes high, so that a acceleration of the scanner motor 30 is slower than in a normal-temperature environment. On the other hand, in the case of a high-temperature environment, the oil viscosity becomes low, so that the acceleration of the scanner motor 30 is faster than in the normal temperature environment. The time from the receipt of the print instruction to the arrival at the exposure permission timing in this embodiment is somewhat different depending on the scanner motor 30 used, but in the case where the periphery of the device is in the normal-temperature environment (23° C.), the time is about 0.5 sec.

(Fixing Permission Timing)

Figure 6:
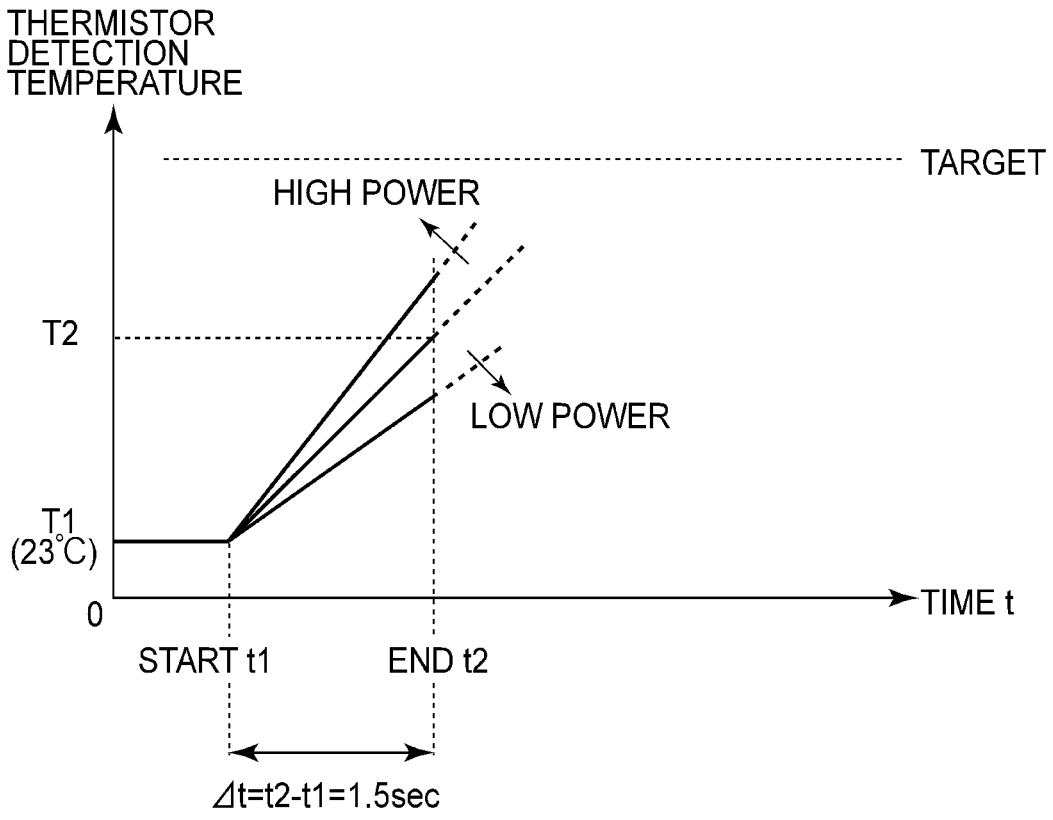
FIG. 6 is a graph for illustrating a temperature rising rate of a detection temperature of a thermistor contacted to a back surface of a heater.

Next, the fixing permission timing (sheet feeding start permission timing at the fixing portion) of the fixing device (fixing portion) 11 in this embodiment will be described. FIG. 6 is a result of monitoring the temperature (temperature rise change) of the thermistor 21 contacting the back surface of the heater 20 in the case where energization is started from a state in which the temperature of the heater 20 is equivalent to an environment temperature (23° C. in the normal temperature environment in this embodiment).

The electric power supplied to the fixing device is different depending on a fluctuation in voltage of a commercial voltage source supplied to the image forming apparatus, so that a temperature rising speed of the heater 20 is faster with a higher supplied power and is a slower with a lower supplied power. That is, with the higher supplied power, even when a time from a start of the energization to a start of the feeding of the recording material is shortened, a sufficient fixing property can be ensured when the recording material reaches the nip N.

Referring to FIG. 6, in this embodiment, a detection temperature (thermistor detection temperature at the time of a start of measurement in FIG. 6) of the thermistor 21 when the energization to the heater 20 is started (t=t1 (sec)) is T1 (° C.). A detection temperature (thermistor detection temperature at the time of an end of measurement in FIG. 6) of the thermistor 21 after a lapse of 1.5 sec (t=t2 (sec)) is T2 (° C.).

Here, the CPU 27 (FIG. 3) functioning as a measuring portion for measuring a temperature rising rate of the detection temperature calculates (measures) a temperature rising rate ΔT (° C./sec)=(T2−T1)/(t2−t1). In this case, Δt=(t2−t1)=1.5 (sec) is a temperature rising rate measurement time (predetermined time required for measuring the temperature rising rate). It is assumed that the supplied (electric) power (voltage of the commercial voltage source) is higher with a larger temperature rising rate Δt (° C./sec), and it is assumed that the supplied power (voltage of the commercial voltage source) is lower with a smaller temperature rising rate ΔT (° C./sec).

Further, when a difference in temperature of the heater 20 due to a difference in supplied power is small, it becomes difficult to detect the difference in temperature rising rate, and therefore, in order to estimate the supplied power with accuracy, there is a need to increase the temperature rising rate measurement time Δt. For that reason, in this embodiment, in order to estimate the supplied power with accuracy, the temperature rising rate measurement time Δt is required to be at least 1.5 (sec). In this embodiment, the temperature rising rate measurement time Δt is fixed at 1.5 (sec). As shown in FIG. 6, the temperature rising rate measurement time (predetermined time) Δt is also an elapsed time from a start of the supply of the power to the heater 20 in response to the print instruction.

As described above, the image forming apparatus of this embodiment is capable of making the fixing permission timing earlier with a larger temperature rising rate ΔT. FIG. 7 is a correspondence table among the temperature rising rate ΔT, a time unit timing of the fixing device reaches the fixing permission timing, and the like. Values in the table are those in the case where the periphery of the device is in the normal-temperature environment (23° C.).

A hot/cold state of the fixing device is selected depending on the thermistor detection temperature (T1 (° C.) at the time of the start of measurement in FIG. 6) when the energization to the heater 20 is started. The cold state of the fixing device refers to a state of T1≤50° C., and the hot state of the fixing device refers to a state of T1>50° C.

Thus, for example, in the case where C≤ΔT<B holds as a result of measurement of the temperature rising rate ΔT, a power state is estimated as a power state III, and as a time from receipt of a print instruction corresponding to the power state III until the timing of the fixing device reaches the fixing permission timing, 1.6 (sec) is determined. Such a mechanism is employed. Incidentally, the power state III corresponds to 900-950 W as an estimated supplied power. In FIG. 7, A to F are thresholds of the respective power states and the times until the timing of the fixing device reaches the fixing permission timing in the respective power states A to F are appropriately selected depending on an initial state of the fixing device, a printing mode, an environment temperature and the like.

(Flowchart)

Figure 8:
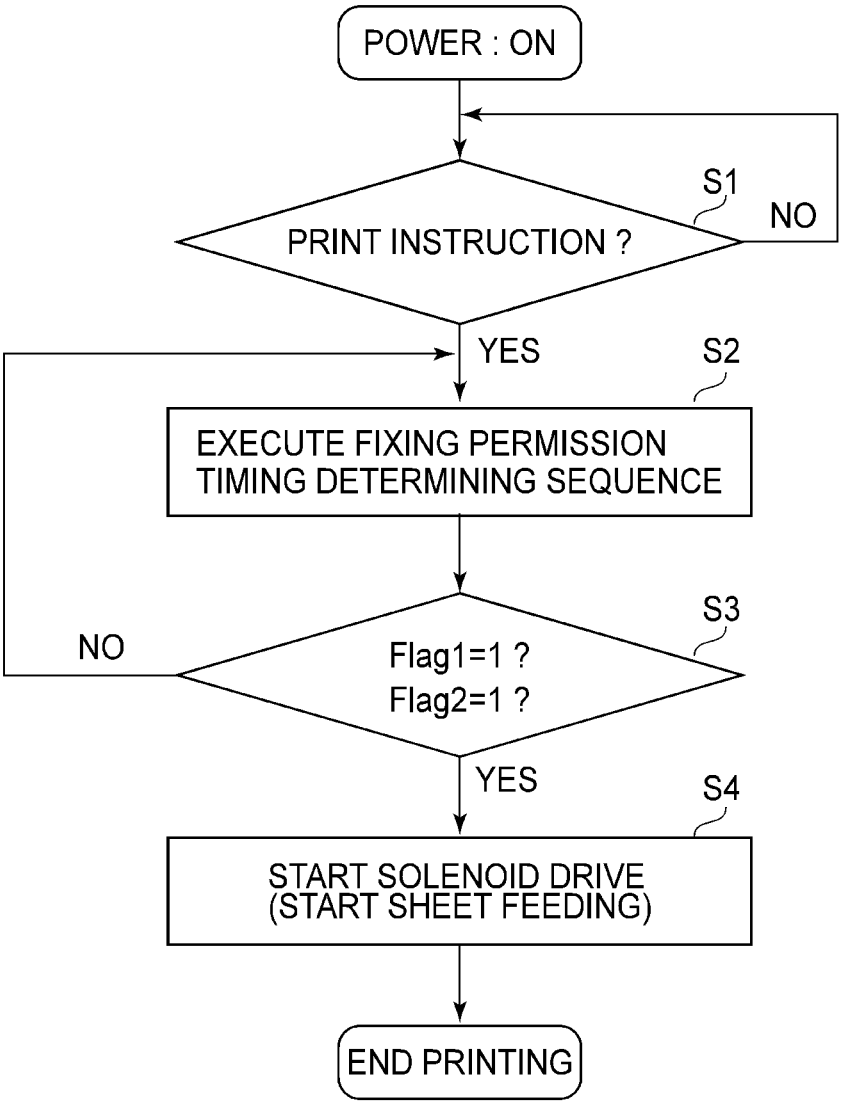
FIG. 8 is a flowchart of a determining sequence of the sheet feeding start timing in the image forming apparatus of this embodiment.

The image forming apparatus of this embodiment operates as shown in a flowchart of FIG. 8 and determines the sheet feeding start timing (timing when both Flag 1 and Flag 2 are 1). For that purpose, the image forming apparatus operates as shown in a flowchart of FIG. 9 and determines fixing permission timing (timing when both Flag 1 and Flag 2 are 1).

First, the sheet feeding start timing determination sequence will be described using FIG. 8. The CPU 27 discriminates whether or not the print instruction is provided (S1), and when the print instruction is provided, a fixing permission timing determination sequence is carried out (S2). Thereafter, when both Flag 1 and Flag 2 are 1 (S3), the solenoid is operated (i.e., sheet feeding is started) (S4).

The fixing permission timing determination sequence carried out in S2 of the flowchart of FIG. 8 will be described using FIG. 9. Energization of the heater 20 is started (t=t0), and at the same time, measurement of a temperature rising rate for an N-th print instruction is started (S11). The CPU 27 discriminates whether or not a measurement result (information (value) relating to the temperature rising rate) of the temperature rising rate is stored in the memory 28 (FIG. 3) as a storing portion (S12), and in the case where the measurement result is stored in the memory 28, the CPU 27 tentatively determines the fixing permission timing as $T_{n-1}$ from the measurement result for an (N−1)-th print instruction (S13).

The tentatively determined fixing permission timing $T_{n-1}$ and the temperature rising rate measurement time ΔT (=1.5

(sec), fixed) are compared with each other, and with $T_{n-1}<\Delta t$ as a condition (S14), the fixing permission timing is determined (fixed) at $T_{n-1}$ (S15). Thereafter, when the timing reaches the fixing permission timing ($t=T_{n-1}$) (S16), Flag 2 is set at 1 (S17). Further, when the temperature rising rate measurement time elapses ($t=\Delta t$) (S18), the CPU 27 as the controller causes the memory 28 (FIG. 3) to store the measurement result of the temperature rising rate for the N-th print instruction (S19).

On the other hand, returning to S12 of FIG. 9, in the case where the measurement result is not stored in the memory 28 (FIG. 3), the CPU 27 causes the storing portion to store the measurement result for the N-th print instruction (S21) when the temp-rising rate measurement time elapses ($t-\Delta e$) (S20). Then, the CPU 27 tentatively determines, as $T_n$, the fixing permission timing for the N-th print instruction based on the measurement result for the N-th print instruction (S22).

Similarly, returning to S14 of FIG. 9, in the case where $T_{n-1}$ is not smaller than $\Delta t$ ($T_{n-1}\geq\Delta t$), the CPU 27 causes the storing portion to store the measurement result for the N-th print instruction (S21) when the temperature rising rate measurement time elapses ($t=\Delta t$) (S20). Then, the CPU 27 tentatively determines, as $T_n$, the fixing permission timing for the N-th print instruction based on the measurement result for the N-th print instruction (S22).

Then, in a situation where the temperature rising rate measurement time $\Delta t$ elapses, the tentatively determined fixing permission timing $T_n$ and the temperature rising rate measurement time $\Delta t$ are compared with each other, with $T_n<\Delta t$ as a condition (S23), the fixing permission timing is determined at $T_n$ (S24). Thereafter, Flag 2 is set at 1 (S25). On the other hand, returning to S23, with $\Delta t\leq T_n$ as a condition, the fixing permission timing is determined at $T_n$ (S26). Thereafter, when the timing reaches the fixing permission timing ($t=T_n$), Flag 2 is set at 1 (S25). The fixing permission timing in the step S26 is a timing when the temperature (detection temperature of the thermistor 21) of the fixing device 11 reaches the above-described fixing temperature or a predetermined temperature lower than the fixing temperature.

Functional Effect of this Embodiment

As described above, in a high power state in which the temperature rising rate $\Delta T$ is large, the image forming apparatus is in a state in which a time from receipt of the print instruction until the timing of the fixing device reaches the fixing permission timing can be shortened. However, in the case where the sheet feeding start timing for the N-th print instruction is determined on the basis of the measurement result of the temperature rising rate for the N-th print instruction, the sheet feeding start timing for the N-th print instruction cannot be inevitably be made earlier than timing required for measurement of the temperature rising rate for the N-th print instruction. Even if the image forming apparatus is in a state in which a time from receipt of the print instruction until the sheet is fed can be made shorter than the temperature rising rate measurement time of 1.5 (sec).

In view of this, in this embodiment, in the case where a predetermined condition is satisfied, the sheet feeding start timing for the N-th print instruction is set at sheet feeding start timing for the (N−1)-th print instruction based on the temperature rising rate for the (N−1)-th print instruction stored in the storing portion. The case where the predetermined condition is satisfied is the case where the sheet feeding start timing for the (N−1)-th print instruction based on the measurement result of the temperature rising rate for the (N−1)-th print instruction stored in the storing portion is earlier than end timing of a predetermined time required for measuring the temperature rising rate. When a commercial voltage source is used, an environment temperature at a periphery of the image forming apparatus and the like largely fluctuate over a short time. In consideration of this tendency, in this embodiment, when the sheet feeding start timing for the N-th print instruction is determined, reference to information on the temperature rising rate for the (N−1)-th print instruction is made.

Figure 9:
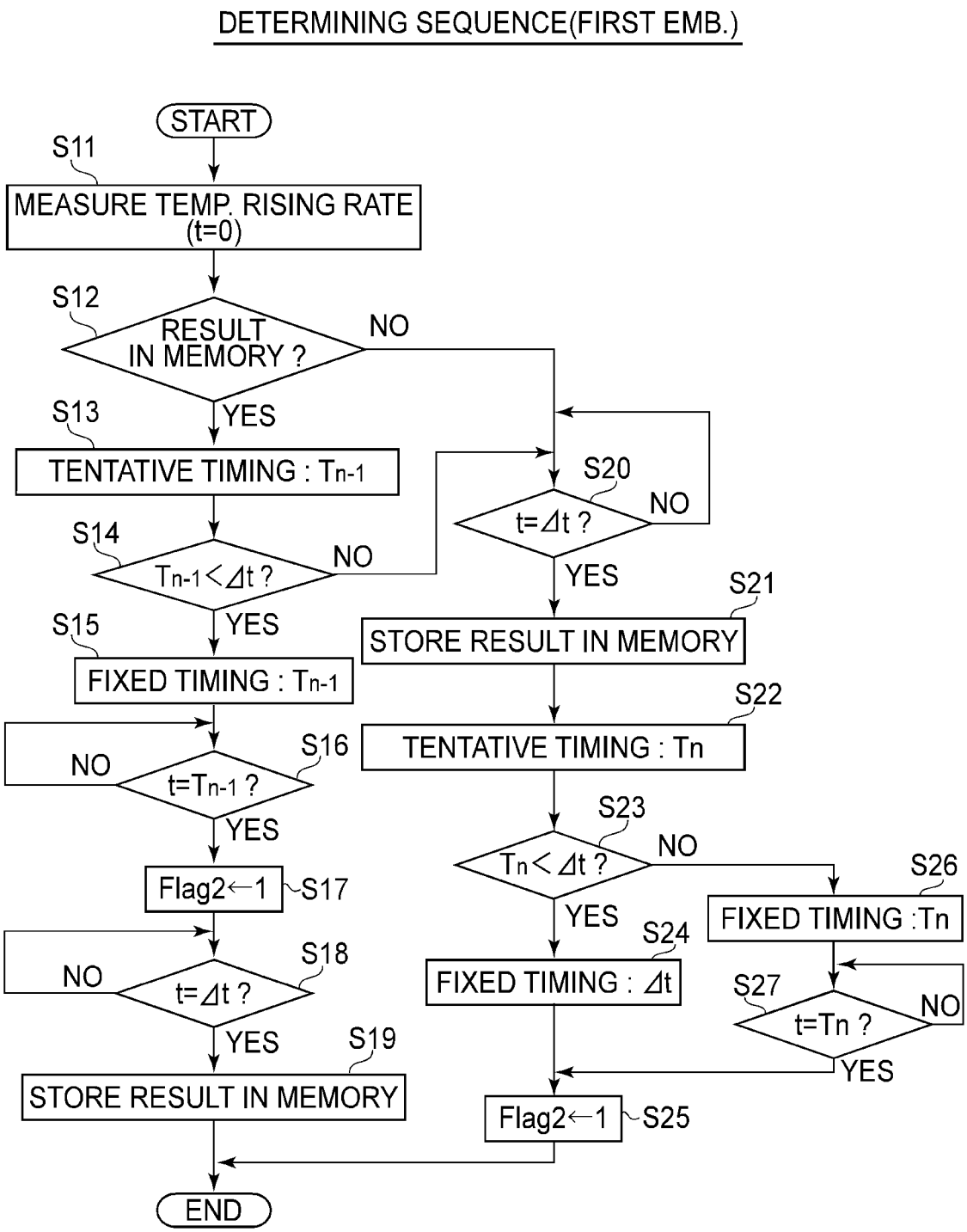
FIG. 9 is a flowchart of a determining sequence of the fixing permission timing in the image forming apparatus of First Embodiment.

Thus, the image forming apparatus of this embodiment executes the time chart of FIG. 5 and the flowcharts of FIGS. 8 and 9. As a result, the sheet feeding start timing after the image forming apparatus receives the N-th print instruction can be made earlier than the end timing of the measurement for the N-th print instruction. That is, the sheet feeding start timing for the N-th print instruction can be made earlier (timewisely) than timing from after the receipt of the print instruction until the time reaches the temperature rising rate measurement time, so that the FPOT can be further shortened.

Experiment in which this Embodiment is Compared with Comparison Example 1

Figure 10:
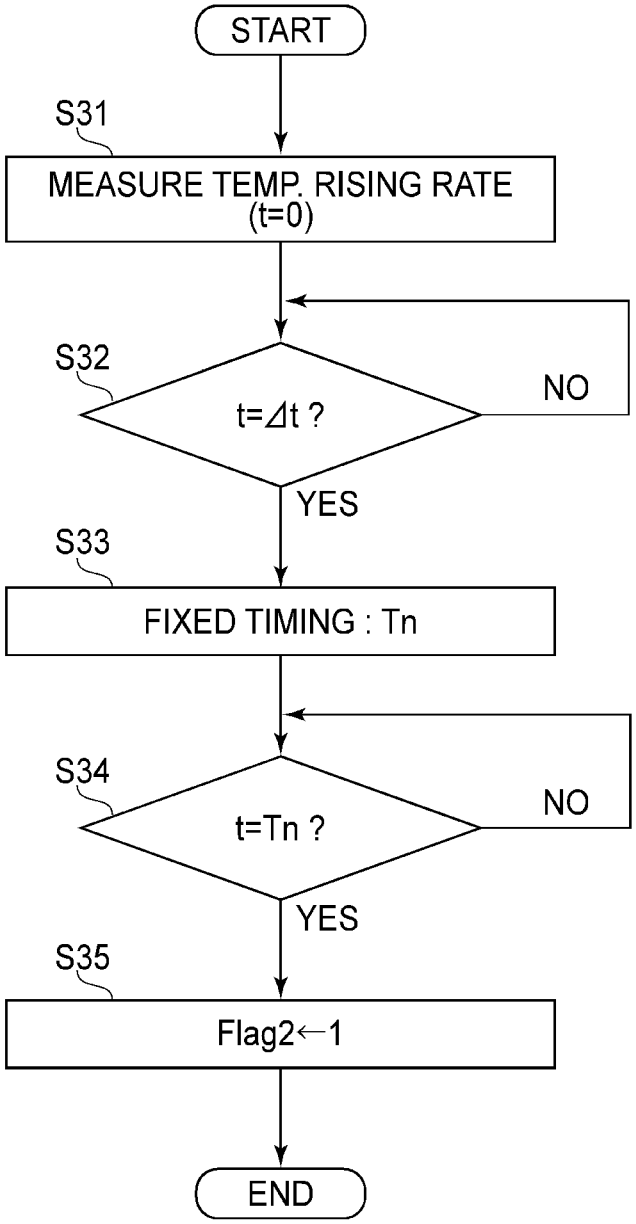
FIG. 10 is a flowchart of a determining sequence of fixing permission timing in an image forming apparatus of Comparison Example 1.

An experiment in which this embodiment is compared with Comparison Example 1 will be described. Basic constitution and operation of an image forming apparatus of Comparison Example 1 are substantially the same as those of the image forming apparatus of this embodiment, but the image forming apparatus of Comparison Example 1 is capable of executing a flowchart of FIG. 10 different from the flowchart of FIG. 9 used in this embodiment (First Embodiment). First, measurement of the temperature rising rate for the N-th print instruction is started simultaneously with energization a start ($t=0$) of energization to the heater (S31). When the temperature rising rate measurement time elapses ($t=\Delta t$) (S32), the fixing permission timing is determined at $T_n$ from a temperature rising rate measurement result for the N-th print instruction (S33). Thereafter, when the timing reaches the fixing permission timing ($t=T_n$) (S34), Flag 2 is set at 1 (S35).

1) Experimental Condition

Environmental temperature: normal temperature (23° C.)
Process speed: 220 mm/sec
Printing mode: plain paper
Paper kind: LTR size (paper length: 297 mm), Vitality (manufactured by Xerox Corp., basis weight: 75 g/m$^2$)
Feeding method: Printing of 6 sheets with 10 min-intermittent feeding per sheet in which supplied (electric) power is changed to 850 W, 950 W and 1050 W for each 2 sheets.

2) Experimental Result

An experimental result is summarized in FIG. 11. In Comparison Example 1 in which the fixing permission timing for N-th print instruction is determined on the basis of the temperature rising rate measurement result for the N-th print instruction, sheet feeding timing for first print instruction is 1.6 (sec).

Then, those for second print instruction and later print instructions are 1.6 (sec), 1.5 (sec), 1.5 (sec), 1.5 (sec) and 1.5 (sec) in tern. Further, the FPOT for the first print instruction is 5.0 (sec), and those for the second print instruction and later print instructions are 5.0 (sec), 4.9 (sec), 4.9 (sec), 4.9 (sec) and 4.9 (sec) in tern.

On the other hand, in this embodiment (first Embodiment, sheet feeding timing for first print instruction is 1.6 (sec), and those for second print instruction and later print instructions are 1.6 (sec), 1.5 (sec), 1.1 (sec), 1.1 (sec) and 0.6 (sec) in tern. Further, the FPOT for the first print instruction is 5.0 (sec), and those for the second print instruction and later print instructions are 5.0 (sec), 4.9 (sec), 4.5 (sec), 4.5 (sec) and 4.0 (sec) in tern.

Thus, when Comparison Example 1 and First Embodiment were compared with each other, in First Embodiment, the FPOT was able to be shortened by 0.9 (sec) at maximum compared with Comparison Example 1.

Summarization of this Embodiment

As described above, in this embodiment, the case where there is no large fluctuation in power source voltage supplied to the image forming apparatus is assumed, and in a predetermined condition, the sheet feeding start timing for the N-th print instruction is set at sheet feeding start timing determined from the temperature rising rate measurement result for the (N−1)-th print instruction. As a result, the FPOT can be further shortened.

Second Embodiment

An image forming apparatus of Second Embodiment has substantially the same constitution and operation as those in First Embodiment. This embodiment is characterized in that a control temperature at which the recording material at the fixing portion is heat-controlled is increased in the case where a measurement result for the N-th print instruction stored in the storing portion is lowered from a measurement result for the (N−1)-th print instruction stored in the storing portion by more than a first thermistor.

There is a case that a difference occurs between a temperature rising rate measurement result for the (N−1)-th print instruction (last power state) and a temperature rising rate measurement result for the N-th print instruction (current power state) in the image forming apparatus of First Embodiment. This is because as described above, the power supplied to the image forming apparatus is different depending on the voltage of the commercial voltage source. An ideal voltage source (power source) is capable of outputting a certain voltage irrespective of a use status of another electronic device, but a general-purpose commercial voltage source fluctuates more than by a little amount.

Accordingly, a case will be considered where although the power state is presumed to be a high power state from the temperature rising rate measurement result for the (N−1)-th print instruction, the voltage of the commercial voltage source is lowered from the (N−1)-th print instruction until the N-th print instruction, and thus the power state changes to a low power state at the N-th print instruction. In this case, the sheet is fed at short sheet feeding start timing from the (N−1)-th print instruction (the high power state), although an actual power state is the low power state. Therefore, there is a possibility that improper fixing occurs.

In this embodiment, the image forming apparatus capable of suppressing the improper fixing which can occur in the case where the temperature rising rate measurement result for the (N−1)-th print instruction and the temperature rising rate measurement result for the N-th print instruction are different from each other.

(Sheet Feeding Sequence)

In view of the above-described circumstances, the image forming apparatus of this embodiment operates as shown in a flowchart of FIG. 8 and determines the sheet feeding start timing (timing when both Flag 1 and Flag 2 are 1) similarly as in First Embodiment. Further, the image forming apparatus operates as shown in flowcharts of FIGS. 12 and 13 and determines fixing permission timing (timing when both Flag 1 and Flag 2 are 1).

First, the sheet feeding start timing determination sequence determination sequence will be described. The sheet feeding start timing determination sequence is performed according to the flowchart of FIG. 8, so that the sheet feeding start timing is determined. The CPU 27 discriminates whether or not the print instruction is provided (S1), and when the print instruction is provided, a fixing permission timing determination sequence is carried out (S2). Thereafter, at timing when both Flag 1 and Flag 2 are 1 (S3), the solenoid is operated (i.e., sheet feeding is started) (S4).

Then, the fixing permission timing determination sequence carried out in S2 of the flowchart of FIG. 8 will be described. The fixing permission timing determination sequence is performed according to a flowchart of FIG. 12, so that the fixing permission timing is determined. Energization to the heater 20 is started (t=t0), and at the same toner, measurement of a temperature rising rate for an N-th print instruction is started (S41). The CPU 27 discriminates whether or not a measurement result is stored in the memory 28 (FIG. 3) as a storing portion (S42), and in the case where the measurement result is stored in the memory 28, the CPU 27 tentatively determines the fixing permission timing as $T_{n-1}$ from the measurement result for an (N−1)-th print instruction (S43).

Then, the tentatively determined fixing permission timing $T_{n-1}$ and the temperature rising rate measurement time $\Delta T$ (=1.5 (sec)) are compared with each other, and with $T_{n-1}<\Delta t$ as a condition (S44), the fixing permission timing is determined at $T_{n-1}$ (S45). Thereafter, when the timing reaches the fixing permission timing ($t=T_{n-1}$) (S46), Flag 2 is set at 1 (S47). Further, when the temperature rising rate measurement time elapses ($t=\Delta t$) (S48), the CPU 27 causes the storing portion to store the measurement result for the N-th print instruction (S49). That is, the CPU 27 causes the storing portion to store the measurement result for the N-th print instruction simultaneously with or after an end of a predetermined time set for the N-th print instruction.

Figure 13:
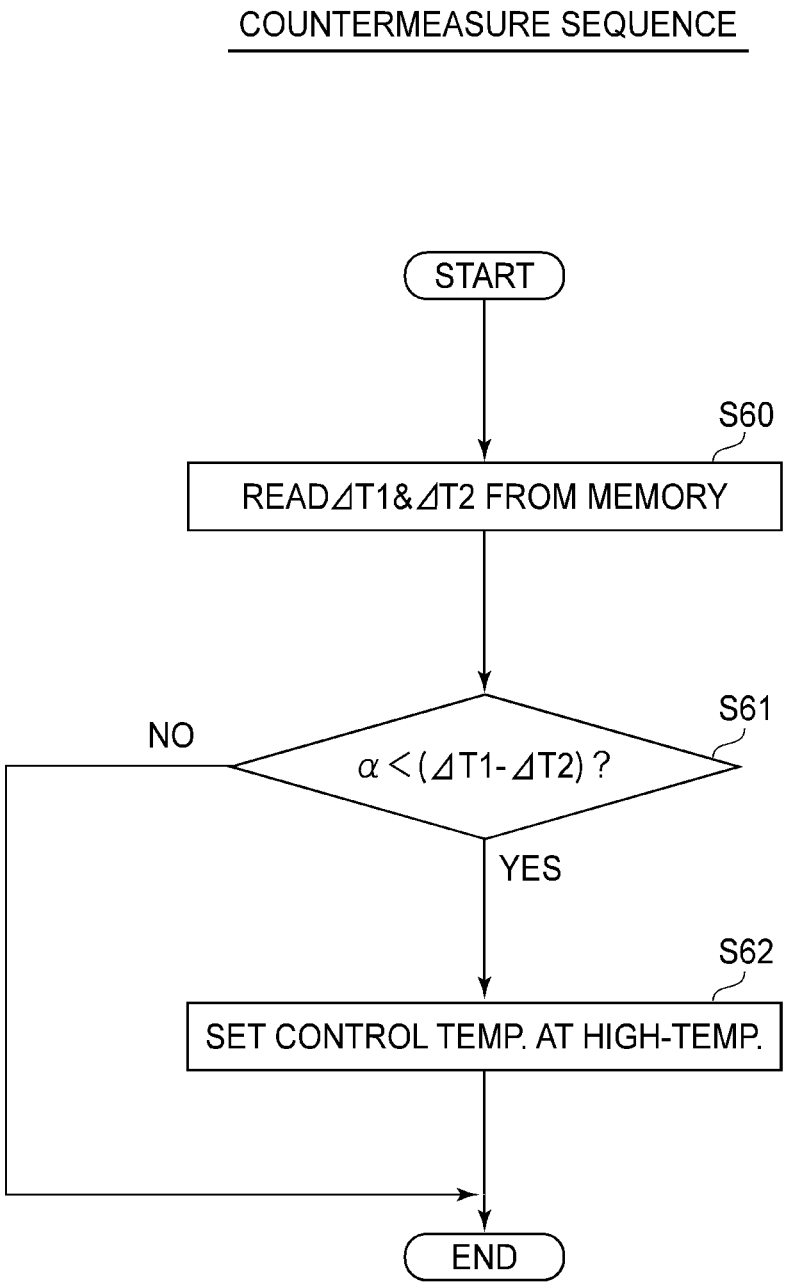
FIG. 13 is a flowchart of a voltage fluctuation countermeasure sequence in the image forming apparatus of Second Embodiment.

Then, a voltage fluctuation countermeasure sequence shown in FIG. 13 described later is carried out (S50).

On the other hand, returning to S42, in the case where the measurement result is not stored in the storing portion, the CPU 27 causes the storing portion to store the measurement result for the N-th print instruction (S52), when the temperature rising rate measurement time elapses ($t=\Delta t$) (S51) and tentatively determines, as $T_n$, the fixing permission timing for the N-th print instruction based on the measurement result for the N-th print instruction (S53).

Similarly, returning to S14 of FIG. 9, in the case where $T_{n-1}$ is not smaller than $\Delta t$, when the temperature rising rate measurement time elapses ($t=\Delta t$) (S51), the CPU 27 causes the storing portion to store the measurement result for the N-th print instruction (S52). That is, the CPU 27 causes the storing portion to store the measurement result for the N-th print instruction simultaneously with or after an end of a predetermined time set for the N-th print instruction. Then, the CPU 27 tentatively determines, as $T_n$, the fixing permission timing for the N-th print instruction based on the measurement result for the N-th print instruction (S53).

The tentatively determined fixing permission timing $T_n$ and the temperature rising rate measurement time Δt are compared with each other, with $T_n$<Δt as a condition (S54), the fixing permission timing is determined at $T_n$ (S55). Thereafter, Flag 2 is set at 1 (S56), and the voltage fluctuation countermeasure sequence is carried out (S50).

On the other hand, returning to S54, with Δt≤$T_n$ as a condition, the fixing permission timing is determined at $T_n$ (S57). Thereafter, when the timing reaches the fixing permission timing (t=$T_n$), (S58), Flag 2 is set at 1 (S56), and the voltage fluctuation countermeasure sequence is carried out (S50).

Figure 12:
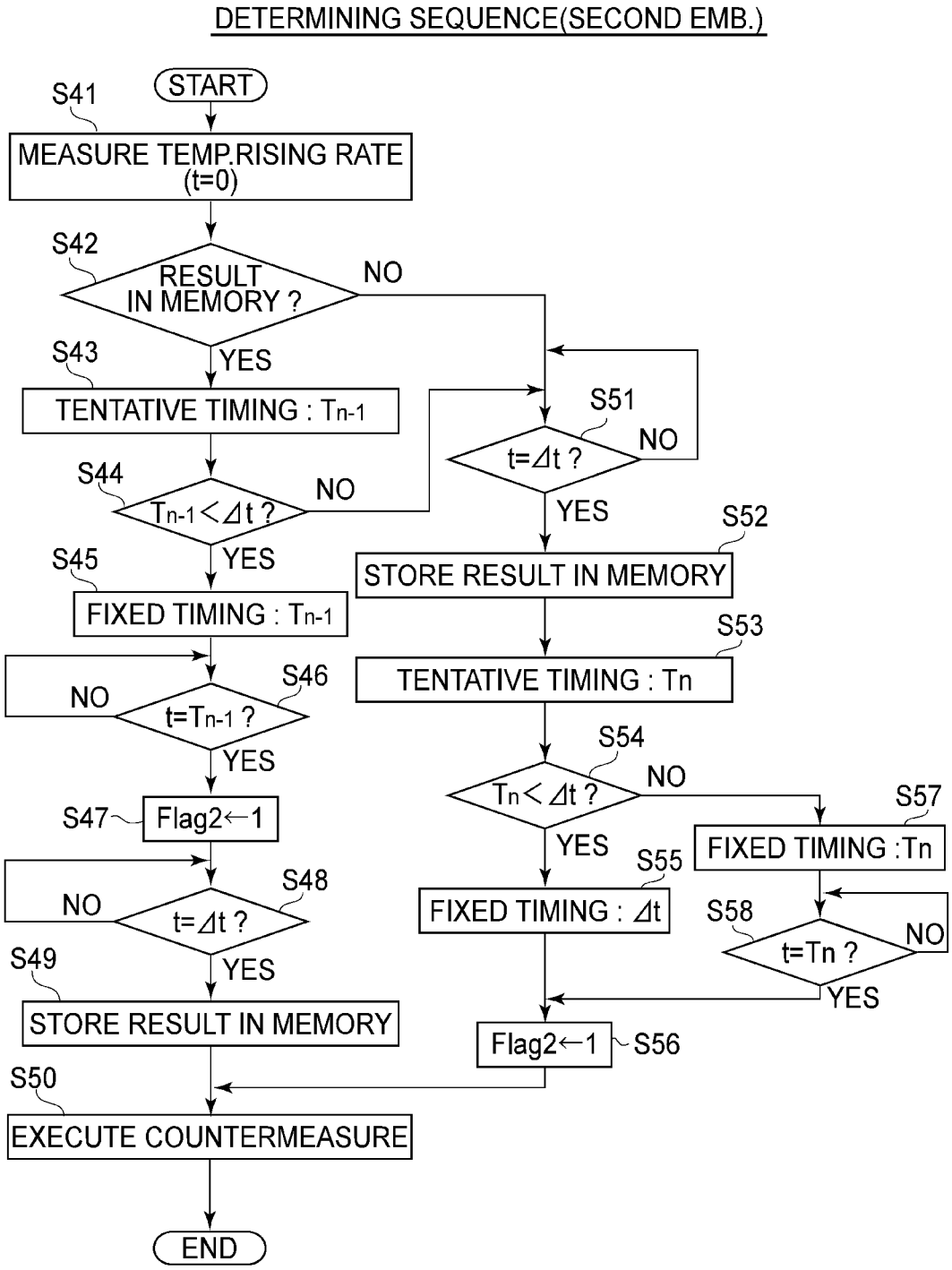
FIG. 12 is a flowchart of a determining sequence of fixing permission timing in an image forming apparatus of Second Embodiment ("EMB. 2").

Further, the voltage fluctuation countermeasure sequence carried out in S50 of the flowchart of FIG. 12 will be described. The voltage fluctuation countermeasure sequence is performed according to a flowchart of FIG. 13. The CPU 27 reads, from the storing portion, a temperature rising rate measurement result ΔT1 for the N-th print instruction and a temperature rising rate measurement result ΔT2 for the (N−1)-th print instruction (S60). Then, the CPU 27 calculates (ΔT1−ΔT2), and with a condition such that (ΔT1−ΔT2) exceeds a (certain) first threshold (threshold α) (S61), the CPU 27 sets a control temperature (fixing temperature) during passing of the recording material through the fixing device, at a temperature on a high-temperature side (S62).

Accordingly, the image forming apparatus of this embodiment feeds the sheet at sheet feeding start timing for the N-th print instruction as sheet feeding start timing determined from the temperature rising rate measurement result for the (N−1)-th print instruction. Thereafter, with a condition such that a difference between the temperature rising rate measurement result for the N-th print instruction and the temperature rising rate measurement result for the (N−1)-th print instruction exceeds the first threshold, the control temperature during the passing of the recording material through the fixing device is changed. This is a feature of this embodiment.

Functional Effect of this Embodiment

The functional effect of this embodiment is similar to that of First Embodiment in principle, and therefore will be omitted from description. However, in this embodiment, even when the power state is changed to the low power state due to a lowering in voltage of the commercial voltage source until the N-th print instruction, although the power state is presumed as the high power state from the temperature rising rate measurement result for the (N−1)-th print instruction, occurrence of improper fixing can be suppressed.

Summarization of this Embodiment

The image forming apparatus of this embodiment is capable of shortening the FPOT while suppressing the occurrence of the improper fixing even when the power state is changed to the low power state due to the lowering in voltage of the commercial voltage source until the N-th print instruction although the power state is presumed as the high power state from the temperature rising rate measurement result for the (N−1)-th print instruction.

Third Embodiment

An image forming apparatus of Third Embodiment has substantially the same constitution and operation as those in Second Embodiment. This embodiment is characterized in that sheet feeding start timing for the N-th print instruction is changed depending on whether or not an elapsed time from the (N−1)-th print instruction to the N-th print instruction is shorter than a second threshold (threshold β).

Figure 14:
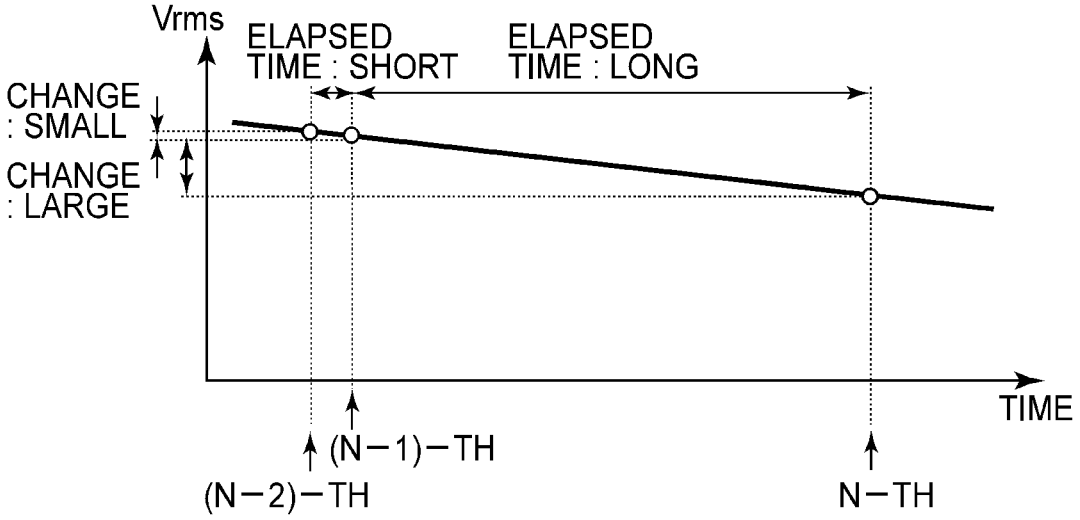
FIG. 14 is a graph showing a change in power source voltage with an elapsed time in Second Embodiment.

There is a possibility that a difference between a temperature rising rate measurement result for the (N−1)-th print instruction (last power state) and a temperature rising rate measurement result for the N-th print instruction (current power state) becomes larger with a longer elapsed time from the (N−1)-th print instruction to the N-th print instruction (FIG. 14). For that reason, with a longer elapsed time, the sheet is fed at short sheet feeding start timing in the high power state although the power state is changed to the lower power state and there is a possibility that improper fixing occurs.

Therefore, in this embodiment, the image forming apparatus capable of suppressing the improper fixing which can occur in the case where the elapsed time from the (N−1)-th print instruction to the N-th print instruction becomes long (i.e., in the case where the power source voltage fluctuates at a medium or long period) is provided.

(Sheet Feeding Sequence)

Figure 15:
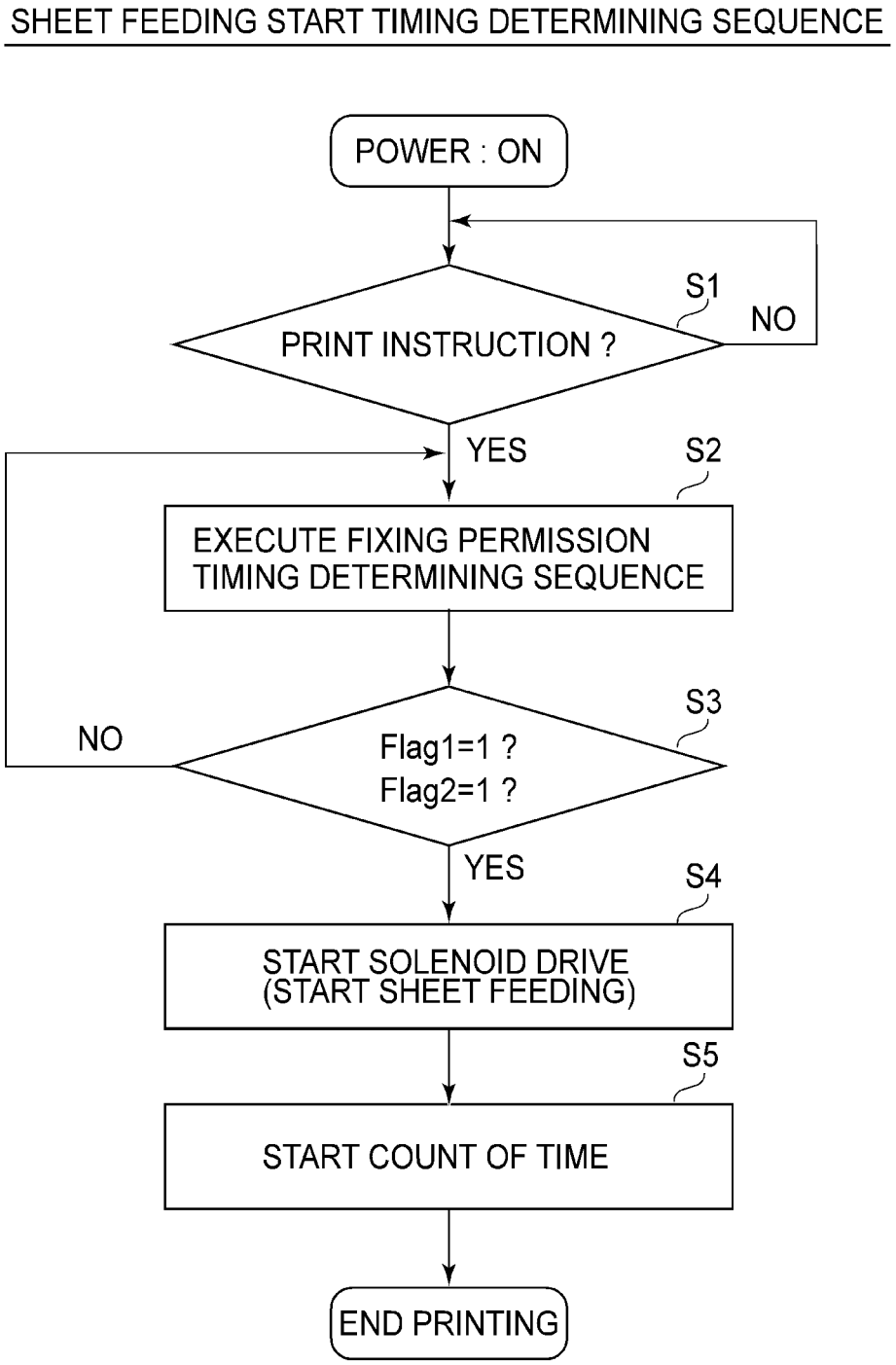
FIG. 15 is a flowchart of a determining sequence of sheet feeding start timing in an image forming apparatus of Third Embodiment.

In view of the above-described circumstances, the image forming apparatus of this embodiment operates as shown in a flowchart of FIG. 15 and determines the sheet feeding start timing (timing when both Flag 1 and Flag 2 are 1). Further, the image forming apparatus operates as shown in flowcharts of FIGS. 13 and 16 and determines fixing permission timing (timing when both Flag 1 and Flag 2 are 1).

First, the sheet feeding start timing determination sequence is determined with reference to the flowchart of FIG. 15. The CPU 27 discriminates whether or not the print instruction is provided (S1), and when the print instruction is provided, a fixing permission timing determination sequence is carried out (S2). Thereafter, at timing when both Flag 1 and Flag 2 are 1 (S3), the solenoid is operated started (i.e., sheet feeding is started) (S4). Further, time count is started (S5).

Figure 16:
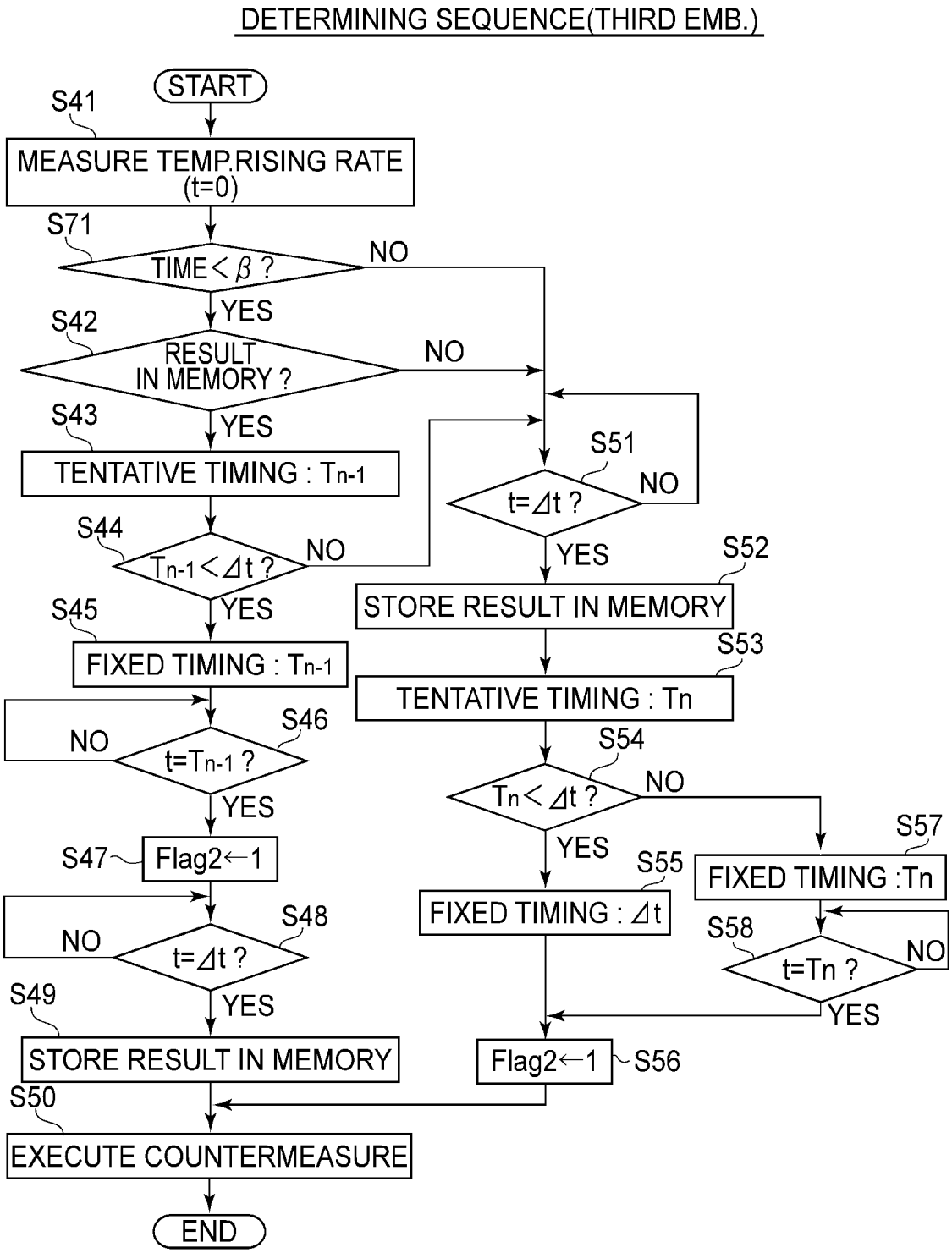
FIG. 16 is a flowchart of a determining sequence of fixing permission timing in the image forming apparatus of Third Embodiment ("EMB. 3").

Then, the fixing permission timing is determined with reference to a flowchart of FIG. 16. Energization of the heater 20 is started (t=t0), and at the same time, measurement of a temperature rising rate for an N-th print instruction is started (S41). The CPU 27 discriminates whether or not the time count of the elapsed time from the (N−1)-th print instruction to the N-th print instruction exceeds the threshold β (S71), and when the time count is smaller than the threshold β, the CPU 27 discriminates whether or not the measurement result is stored in the storing portion (S42).

Further, in the case where the measurement result is stored in the storing portion, the CPU 27 tentatively determines the fixing permission timing as $T_{n-1}$ from the measurement result for an (N−1)-th print instruction (S43). Then, the tentatively determined fixing permission timing $T_{n-1}$ and the temperature rising rate measurement time ΔT are compared with each other, and with $T_{n-1}$<Δt as a condition (S44), the fixing permission timing is determined at $T_{n-1}$ (S45). Thereafter, when the timing reaches the fixing permission timing (t=$T_{n-1}$) (S46), Flag 2 is set at 1 (S47). Further, when the temperature rising rate measurement time elapses (t=Δt) (S48), the CPU 27 causes the storing portion to store the measurement result for the N-th print instruction (S49), and carries out the voltage fluctuation countermeasure sequence (S50).

On the other hand, returning to S44 of FIG. 16, in the case where $T_{n-1}$ is not smaller than Δt, when the temperature rising rate measurement time elapses (t=Δt) (SM), the CPU 27 causes the storing portion to store the measurement result for the N-th print instruction (S52). Then, the CPU 27 tentatively determines, as $T_n$, the fixing permission timing for the N-th print instruction based on the measurement result for the N-th print instruction (S53).

The tentatively determined fixing permission timing $T_n$ and the temperature rising rate measurement time Δt are compared with each other, with $T_n<\Delta t$ as a condition (S54), the fixing permission timing is determined at $T_n$ (S55). Thereafter, Flag 2 is set at 1 (S56), and the voltage fluctuation countermeasure sequence is carried out (S50).

On the other hand, returning to S54, with $\Delta t \leq T_n$ as a condition, the fixing permission timing is determined at $T_n$ (S57). Thereafter, when the timing reaches the fixing permission timing ($t=T_n$), (S58), Flag 2 is set at 1 (S56), and the voltage fluctuation countermeasure sequence is carried out (S50).

On the other hand, when the time count is the threshold β or more in the case of returning to S71 or there is no measurement result in the case of returning to S42, the CPU 27 causes the storing portion to store the measurement result for the N-th print instruction (S52) when the temperature rising rate measurement time elapses (t=Δt) (S51). Then, the CPU 27 tentatively determines the fixing permission timing at $T_n$ from the measurement result for the N-th print instruction (S53). The tentatively determined fixing permission timing $T_n$ and the temperature rising rate measurement time ΔT are compared with each other, with $T_n-\Delta t$ as a condition (S54), the fixing permission timing is determined at Δt (S55). Thereafter, Flag 2 is set at 1 (S56), and the voltage fluctuation countermeasure sequence is carried out (S50).

On the other hand, returning to S54, with $\Delta t \leq T_n$ as a condition, the fixing permission timing is determined at $T_n$ (S57). Thereafter, when timing reaches the fixing permission timing ($t=T_n$) (S58), Flag 2 is set at 1 (S56), and the voltage fluctuation countermeasure sequence is carried out (S50).

As described above, in this embodiment, in the case where the elapsed time from the last print instruction to the current print instruction exceeds a certain threshold when the sheet feeding timing for the current print instruction is determined, a constitution in which the sheet feeding timing determined from the measurement result after the last print instruction stored in the storing portion is not used is employed.

Functional Effect of this Embodiment

The functional effect of this embodiment is similar to those of First and Second Embodiments in principle, and therefore, will be omitted from description. However, compared with First and Second Embodiments, improper fixing which can occur in the case where the elapsed time from the (N−1)-th print instruction to the N-th print instruction becomes long (i.e., in the case where the power source voltage fluctuates at a medium or long period) can be suppressed.

Summarization of this Embodiment

As described above, in this embodiment, the FPOT can be shortened while enabling suppressing of the occurrence of the improper fixing which can occur in the case where the elapsed time from the (N−1)-th print instruction to the N-th print instruction becomes long, i.e., in the case where the power source voltage fluctuates at the medium or long period.

Fourth Embodiment

An image forming apparatus of Fourth Embodiment has substantially the same constitution and operation as those in Third Embodiment. This embodiment is characterized in that sheet feeding start timing for the N-th print instruction is changed depending on whether or not a fluctuation range of the measurement result for the Nth print instruction relative to a plurality of measurement results for preceding print instructions including the (N−1)-th print instruction is smaller than a third threshold (threshold γ).

Figure 17:
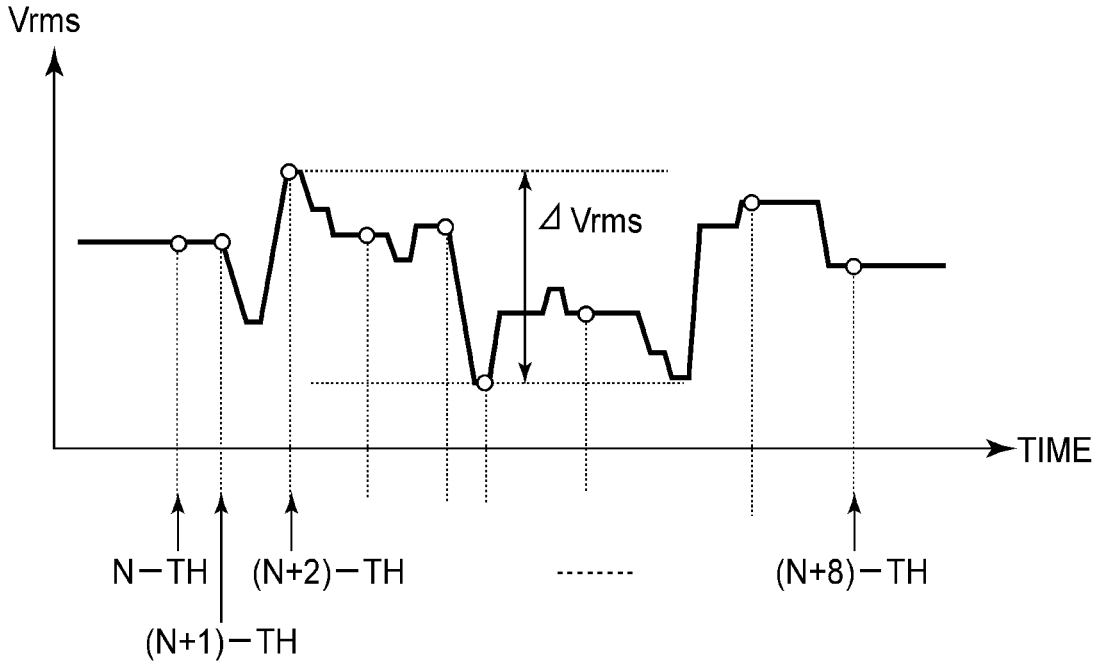
FIG. 17 is a graph showing a change in power source voltage with an elapsed time in Third Embodiment.

There is possibility that the voltage of the commercial voltage source fluctuates for a short time period, and a difference between a temperature rising rate measurement result for the (N−1)-th print instruction (last power state) and a temperature rising rate measurement result for the N-th print instruction (current power state) becomes larger with a larger fluctuation range (FIG. 17). For that reason, the voltage of the commercial voltage source fluctuates at the short time period and with a larger elapsed time, the sheet is fed at short sheet feeding start timing in the high power state although the power state is changed to the lower power state and therefore, there is possibility that improper fixing occurs.

Therefore, in this embodiment, the image forming apparatus capable of suppressing the improper fixing which can occur in the case where the power source voltage fluctuates at the short time period is provided.

(Sheet Feeding Sequence)

In view of the above-described circumstances, the image forming apparatus of this embodiment operates as shown in a flowchart of FIG. 15 and determines the sheet feeding start timing (timing when both Flag 1 and Flag 2 are 1). Further, the image forming apparatus operates as shown in flowcharts of FIGS. 15 and 18 and determines fixing permission timing (timing when both Flag 1 and Flag 2 are 1).

Figure 18:
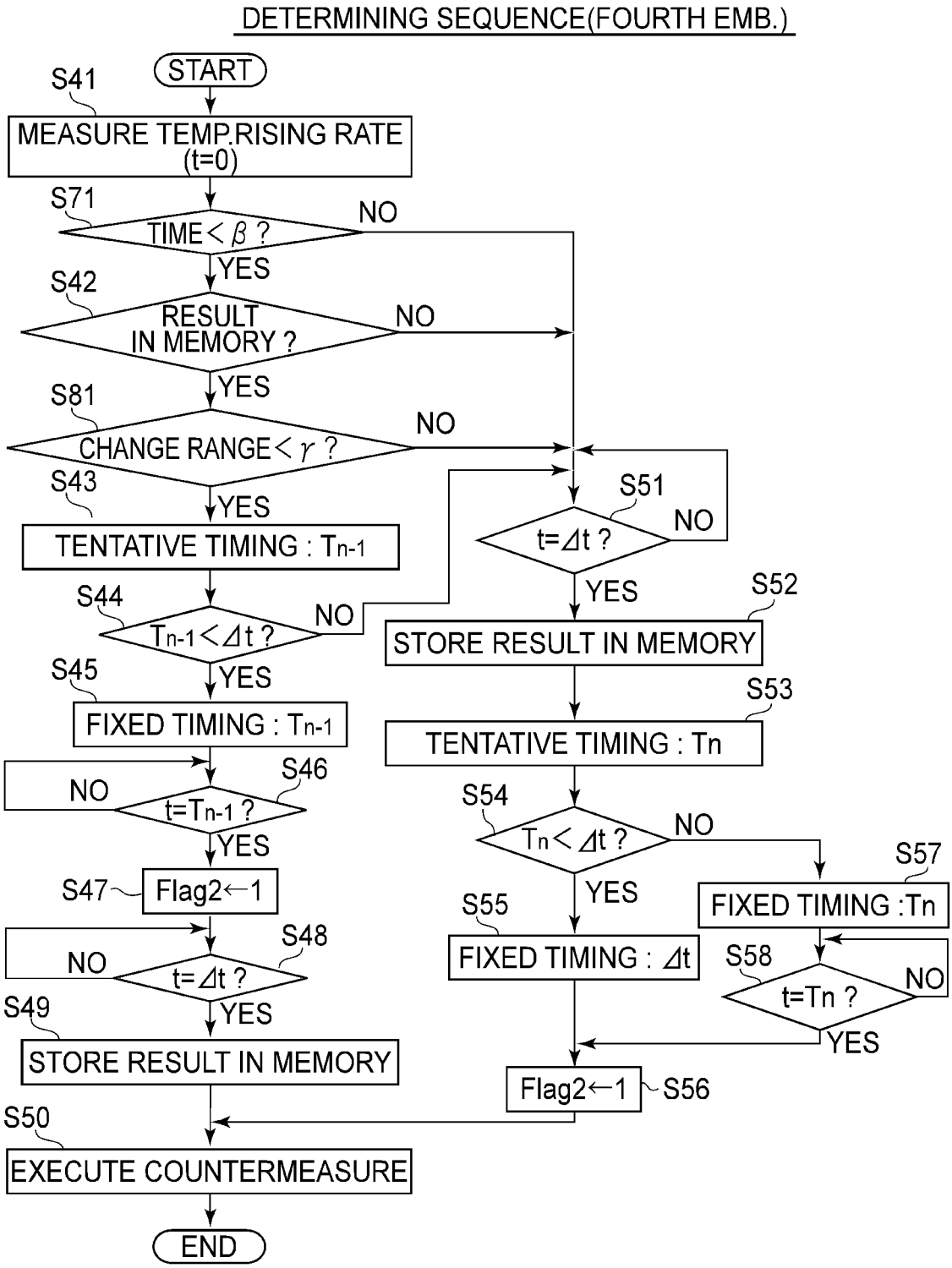
FIG. 18 is a flowchart of a determining sequence of fixing permission timing in an image forming apparatus of Fourth Embodiment.

In this embodiment, the fixing permission timing is determined with reference to a flowchart of FIG. 18. Energization of the heater 20 is started (t=t0), and at the same time, measurement of a temperature rising rate for an N-th print instruction is started (S41). Then, the CPU 27 discriminates whether or not the time count of the elapsed time from the (N−1)-th print instruction to the N-th print instruction exceeds the threshold β (S71).

When the time count is smaller than the threshold β, the CPU 27 discriminates whether or not the measurement result is stored in the storing portion (S42), and in the case where the measurement result is stored in the storing portion, the CPU 27 discriminates whether or not the fluctuation range of the several preceding temperature rising rate measurement results exceeds the threshold γ (S81). When the fluctuation range exceeds the threshold γ, the CPU 27 tentatively determines the fixing permission timing as $T_{n-1}$ from the measurement result for an (N−1)-th print instruction (S43). Then, the tentatively determined fixing permission timing $T_{n-1}$ and the temperature rising rate measurement time ΔT are compared with each other, and with $T_{n-1}<\Delta t$ as a condition (S44), the fixing permission timing is determined at $T_{n-1}$ (S45). Thereafter, when the timing reaches the fixing permission timing ($t=T_{n-1}$) (S46), Flag 2 is set at 1 (S47). Further, when the temperature rising rate measurement time elapses (t=Δt) (S48), the CPU 27 causes the storing portion to store a currently measured temperature rising rate $\Delta T_n$ (S49), and carries out the voltage fluctuation countermeasure sequence (S50).

On the other hand, returning to S44 of FIG. 18, in the case where $T_{n-1}$ is not smaller than Δt, when the temperature rising rate measurement time elapses (t=Δt) (SM), the CPU 27 causes the storing portion to store the measurement result for the N-th print instruction (S52). Then, the CPU 27 tentatively determines, as $T_n$, the fixing permission timing for the N-th print instruction based on the measurement result for the N-th print instruction (S53).

The tentatively determined fixing permission timing $T_n$ and the temperature rising rate measurement time Δt are compared with each other, with $T_n<\Delta t$ as a condition (S54), the fixing permission timing is determined at $T_n$ (S55). Thereafter, Flag 2 is set at 1 (S56), and the voltage fluctuation countermeasure sequence is carried out (S50).

On the other hand, in the case where returning to S71 of FIG. 18, the time count is the threshold β or more or in the case where returning to S42, there is no measurement result or in the case where returning to S81, the fluctuation range of the preceding several temperature rising rate measurement results, the following operation is performed. That is, when the temperature rising rate measurement time elapses (t=Δt) (S51), the CPU 27 causes the storing portion to store the measurement result for the N-th print instruction (S52), and tentatively determines the fixing permission timing at $T_n$ from the measurement result for the N-th print instruction (S53).

The tentatively determined fixing permission timing $T_n$ and the temperature rising rate measurement time ΔT are compared with each other, with $T_n-\Delta t$ as a condition (S54), the fixing permission timing is determined at Δt (S55). Thereafter, Flag 2 is set at 1 (S56), and the voltage fluctuation countermeasure sequence is carried out (S50). On the other hand, returning to S54, with $\Delta t\leq T_n$ as a condition, the fixing permission timing is determined at $T_n$ (S57). Thereafter, when timing reaches the fixing permission timing ($t=T_n$) (S58), Flag 2 is set at 1 (S56), and the voltage fluctuation countermeasure sequence is carried out (S50).

Functional Effect of this Embodiment

The functional effect of this embodiment is similar to those of either one of First to Third Embodiments in principle, and therefore, will be omitted from description. However, compared with either one of First to Third Embodiments, improper fixing which can occur in the case where the voltage of the commercial voltage source used in the image forming apparatus fluctuates at the short time period can be suppressed.

Summarization of this Embodiment

As described above, in this embodiment, the FPOT can be shortened while suppressing the occurrence of the improper fixing which can occur in the case where the voltage of the commercial voltage source used in the image forming apparatus fluctuates at the short time period.

Modified Embodiments

In the above preferred embodiments of the present invention were described, but the present invention is not limited thereto and can be variously modified or changed within the scope thereof. In the above-described embodiments, the thermistor 21 detects the temperature of the heater 20 but may also detect the temperature of the fixing film 25 or the temperature of the pressing roller 26.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-022967 filed on Feb. 13, 2018, which is hereby incorporated by reference herein in its entirety.

What is claimed is:

1. An image forming apparatus comprising:

an image forming portion configured to form a toner image on a recording material;

a fixing portion configured to fix the toner image on the recording material by heating the toner image formed on the recording material;

a temperature detecting portion configured to detect a temperature of said fixing portion;

a measuring portion configured to measure, with said temperature detecting portion, a temperature rising rate of said fixing portion when the temperature of said fixing portion rises, upon receipt of a print instruction, to a predetermined temperature at which the toner image is fixable;

a storing portion configured to store a value related to the temperature rising rate measured by said measuring portion, the value relating to the temperature rising rate for an (N−1)-th print instruction being stored in said storing portion; and a controller configured to control feeding start timing of the recording material, wherein said controller is capable of setting (i) a case in which a start of feeding of the recording material is permitted after a lapse of a predetermined time needed to measure the temperature rising rate and (ii) a case in which the start of feeding of the recording material is permitted, depending on the value stored in said storing portion, at a timing before the lapse of the predetermined time, and wherein, when the value for the (N−1)-th print instruction is less than a value relating to the predetermined time, said controller sets a timing of permission of a start of feeding of the recording material for an N-th print instruction at timing before a lapse of the predetermined time and depending on the value stored in said storing portion.

2. An image forming apparatus according to claim 1, wherein, when the value for the (N−1)-th print instruction stored in said storing portion is less than the value relating to the predetermined time, said controller sets the timing of permission of the start of feeding of the recording material for the N-th print instruction at the timing of the value stored in said storing portion.

3. An image forming apparatus according to claim 1, wherein, when the value for the (N−1)-th print instruction stored in said storing portion is greater than the value relating to the predetermined time, said controller sets the timing of permission of the start of feeding of the recording material for the N-th print instruction at a timing after a lapse of the predetermined time.

4. An image forming apparatus according to claim 1, wherein said image forming apparatus causes said measuring portion to measure the temperature rising rate for each print instruction and then causes said storing portion to store a value relating to the measured temperature rising rate for each print instruction.

5. An image forming apparatus according to claim 1, wherein the value relating to the temperature rising rate is time.

6. An image forming apparatus according to claim 1, wherein, when a difference between the value for the (N−1)-th print instruction and the value for the N-th print instruction exceeds a threshold, said controller corrects a target temperature of said fixing portion when the toner image is fixed on the recording material.

7. An image forming apparatus according to claim 1, wherein, when a time difference between the time that the value for the (N−1)-th print instruction is input and the time that the value for the N-th print instruction is input exceeds a threshold, said controller sets the timing of the start of feeding of the recording material at a timing after the predetermined time elapses.

8. An image forming apparatus according to claim 1, wherein, when a fluctuation range of measurement results of the temperature rising rate for a plurality of print instructions exceeds a threshold, said controller sets the timing of the start of feeding of the recording material at a timing after the predetermined time elapses.

9. An image forming apparatus according to claim 1, wherein said fixing portion includes a cylindrical film contactable to the toner image on the recording material and a heater configured to heat the toner image through said film in contact with an inner surface of said film.

10. An image forming apparatus according to claim 9, wherein said fixing portion includes a pressing roller configured to form a fixing nip, for nipping and feeding the recording material, between itself and said film in cooperation with said heater.

11. An image forming apparatus according to claim 10, wherein said detecting portion detects a temperature of at least one of said film, said heater and said pressing roller.

12. An image forming apparatus comprising:

an image forming portion configured to form a toner image on a recording material;

a fixing portion including a heater and configured to fix the toner image on the recording material by heating the toner image formed on the recording material;

a temperature detecting portion configured to detect a temperature of said fixing portion;

a measuring portion configured to measure, with said temperature detecting portion, a temperature rising rate of said fixing portion when the temperature of said fixing portion rises, upon receipt of a print instruction, to a predetermined temperature at which the toner image is fixable;

a storing portion configured to store a value related to the temperature rising rate measured by said measuring portion the value relating to the temperature rising rate for an (N−1)-th print instruction being stored in said storing portion; and a controller configured to control feeding start timing of the recording material, wherein said controller is capable of setting (i) a case in which a start of feeding of the recording material is permitted after a lapse of a predetermined time from a start of supply of electrical power to said heater in response to a print instruction and (ii) a case in which that the start of feeding of the recording material is permitted, depending on the value stored in said storing portion, at a timing before the lapse of the predetermined time, and wherein, when the value for the (N−1)-th print instruction is less than a value relating to the predetermined time, said controller sets timing of permission of a start of feeding of the recording material for an N-th print instruction at timing before a lapse of the predetermined time and depending on the value stored in said storing portion.

13. An image forming apparatus according to claim 12, wherein, when the value for the (N−1)-th print instruction stored in said storing portion is less than the value relating to the predetermined time, said controller sets the timing of permission of the start of feeding of the recording material for the N-th print instruction at the timing of the value stored in said storing portion.

14. An image forming apparatus according to claim 12, wherein, when the value for the (N−1)-th print instruction stored in said storing portion is greater than the value relating to the predetermined time, said controller sets the timing of permission of the start of feeding of the recording material for the N-th print instruction at a timing after a lapse of the predetermined time.

15. An image forming apparatus according to claim 12, wherein said image forming apparatus causes said measuring portion to measure the temperature rising rate for each print instruction and then causes said storing portion to store a value relating to the measured temperature rising rate for each print instruction.

16. An image forming apparatus according to claim 12, wherein said fixing portion includes a cylindrical film contactable to the toner image on the recording material and a heater configured to heat the toner image through said film in contact with an inner surface of said film.

17. An image forming apparatus according to claim 16, wherein said fixing portion includes a pressing roller configured to form a fixing nip, for nipping and feeding the recording material, between itself and said film, in cooperation with said heater.

18. An image forming apparatus according to claim 17, wherein said detecting portion detects a temperature of at least one of said film, said heater and said pressing roller.

19. An image forming apparatus according to claim 1, wherein said fixing portion includes a cylindrical film contactable to the toner image on the recording material and a heater configured to heat the toner image through said film, the heater being provided in an inner space of said film.

20. An image forming apparatus according to claim 19, wherein said fixing portion includes a pressing roller configured to form a fixing nip, for nipping and feeding the recording material, between itself and said film in cooperation with said heater.

21. An image forming apparatus according to claim 20, wherein said detecting portion detects a temperature of at least one of said film, said heater, and said pressing roller.

22. An image forming apparatus according to claim 12, wherein said fixing portion includes a cylindrical film contactable to the toner image on the recording material and a heater configured to heat the toner image through said film, the heater being provided in an inner space of said film.

23. An image forming apparatus according to claim 22, wherein said fixing portion includes a pressing roller configured to form a fixing nip, for nipping and feeding the recording material, between itself and said film, in cooperation with said heater.

24. An image forming apparatus according to claim 23, wherein said detecting portion detects a temperature of at least one of said film, said heater, and said pressing roller.

* * * * *